US008092666B2

(12) United States Patent
Matsuoka et al.

(10) Patent No.: US 8,092,666 B2
(45) Date of Patent: Jan. 10, 2012

(54) METHOD FOR FABRICATING PLATED PRODUCT

(75) Inventors: Ryoji Matsuoka, Aichi-ken (JP); Muneo Furutani, Aichi-ken (JP); Masato Nasu, Aichi-ken (JP); Takeshi Inoue, Aichi-ken (JP)

(73) Assignee: Toyoda Gosei Co., Ltd., Aichi-pref. (JP)

( * ) Notice: Subject to any disclaimer, the term of this patent is extended or adjusted under 35 U.S.C. 154(b) by 957 days.

(21) Appl. No.: 12/076,866

(22) Filed: Mar. 25, 2008

(65) Prior Publication Data

US 2008/0237052 A1 Oct. 2, 2008

(30) Foreign Application Priority Data

Mar. 29, 2007 (JP) ..... 2007-088917
Oct. 26, 2007 (JP) ..... 2007-279403

(51) Int. Cl.
*C25D 5/02* (2006.01)

(52) U.S. Cl. ..... 205/118; 205/97

(58) Field of Classification Search ..... 205/96, 205/97, 118

See application file for complete search history.

(56) References Cited

U.S. PATENT DOCUMENTS 3,862,891 A * 1/1975 Smith ..... 205/96
3,926,772 A 12/1975 Cordone et al.
7,160,421 B2 * 1/2007 Wilson et al. ..... 204/229.4

FOREIGN PATENT DOCUMENTS

JP A-3-285097 12/1991

OTHER PUBLICATIONS

Notification of the First Office Action issued from the Chinese State Intellectual Property Office on Oct. 23, 2009 for the corresponding Chinese patent application No. 200810084818.0 (with English translation).

* cited by examiner

*Primary Examiner* — Luan Van
(74) *Attorney, Agent, or Firm* — Posz Law Group, PLC

(57) ABSTRACT

A bumper molding is fabricated by disposing segmented anodes 31 and 32 on surfaces 22 and 24 of a base material 20, which are to be plated, and performing electroplating so as to form metal films on the surfaces 22 and 24, respectively. The curvature of a surface of a concave portion, which is formed in each part of the surfaces 22 and 24 so that the surface of the concave portion is away from the segmented anodes 31 and 32, respectively, is larger than those of other portions at a part serving as a border between the second plated surface 22 and the fourth plated surface 24. Accordingly, the distance from the part serving as the border between the second plated surface 22 and the fourth plated surface 24 to a metal case 50*a* corresponding to this part is set so as to be shorter than those from each of the other parts to the metal cases 50*a* and 50*b* respectively corresponding to the segmented anodes 31 and 32.

14 Claims, 14 Drawing Sheets

FIG. 11

| SAMPLE | DISTANCE: L | PLATE WIDTH: W | EXTRA WIDTH: x | BASE MATERIAL SURFACE WIDTH | FILM THICKNESS MAX | FILM THICKNESS MIN | END PART FILM THICKNESS | CENTRAL POSITION FILM THICKNESS | MAX/MIN |
|---|---|---|---|---|---|---|---|---|---|
| A | 50 | 100 | 0 | 100 | 32.36 | 17.92 | 32.36 | 17.92 | 181% |
| B | 50 | 20 | 40 | 100 | 28.04 | 18.66 | 28.04 | 20.93 | 150% |
| C | 30 | 100 | 0 | 100 | 29.31 | 19.35 | 29.31 | 19.35 | 151% |
| D | 30 | 60 | 20 | 100 | 23.73 | 18.80 | 23.73 | 22.73 | 126% |
| E | 20 | 100 | 0 | 100 | 26.40 | 20.41 | 26.40 | 40.41 | 129% |
| F | 20 | 80 | 10 | 100 | 23.02 | 19.55 | 23.02 | 22.30 | 118% |
| G | 10 | 100 | 0 | 100 | 23.03 | 21.55 | 23.03 | 21.80 | 107% |
| H | 10 | 96 | 2 | 100 | 22.20 | 21.06 | 21.63 | 22.20 | 105% |

METHOD FOR FABRICATING PLATED PRODUCT

BACKGROUND OF THE INVENTION

1. Field of the Invention

The present invention relates to a method for fabricating a plated product with a base material having a plated surface on which a metal film is formed by electroplating.

2. Description of the Related Art

Hitherto, in the case of fabricating a plated product having a three-dimensional shape by electroplating, an electric current density at each part of a plated surface of a base material, on which plating is performed, has been uniformed so as to uniformly form a metal film on the plated surface without unevenness of the thickness thereof. More specifically, an exemplary countermeasure taken to uniform the electric current density at each part of the plated surface is to provide an auxiliary electrode at each part, at which the electric current density is likely to be low, in addition to a main electrode.

According to a method for fabricating a plated product, which is described in Patent Document 1, an anode is constituted by arranging a plurality of elements, such as wire members, thin rods, or thin tubes, in parallel and by tying together the arranged elements. Then, the anode is disposed so that ends of the wire members or the like constituting the anode are arranged along the plated surface. Thus, the distance between the anode and each part of the plated surface is maintained at a constant value in the direction of an axis of each of the arranged wire members or the like. Consequently, the electric current density at each part of the plated surface is uniformed.

Patent Document 1: JP-A-3-285097

Meanwhile, according to the method for fabricating a plated product, which is described in the Patent Document 1, although the distance between the anode and each part of the plated surface is maintained at a constant value in the direction of the axis of the wire members or the like constituting the anode, the shortest distance therebetween is not maintained at a constant value. Therefore, the electric current density at each part of the plated surface is not necessarily uniform. In some cases, for example, in a case where the plated surface has a curved shape, it is impossible to form an anode configured so that the shortest distance therebetween is constant.

Incidentally, although electric current flowing from the anode to each part of the base material is controlled by providing an auxiliary electrode as described above, the uniformity of the metal film can be enhanced. In this case, a fabricating apparatus is inevitably complicated.

SUMMARY OF THE INVENTION

The invention is accomplished in view of such circumstances. An object of the invention is to provide a method for fabricating a plated product, which can more surely uniform the thickness of a metal film to be formed on the plated surface of the product, with a simple configuration, in a case where a metal film is formed on a product's surface to be plated by electroplating.

To achieve the foregoing object, according to an aspect of the invention, there is provided a method (hereunder referred to as a first method of the invention) for fabricating a plated product by disposing an anode at the side of a surface of a base material, which is to be plated, (hereunder sometimes referred to simply as a plated surface) and performing electroplating on the surface of the base material so as to form a metal film on the plated surface. The first method of the invention has a gist in that the anode is disposed so that at the electroplating, the distance from each part of the plated surface to the anode is increased as the curvature of a convex part protruding toward the anode increases at each part of the plated surface.

In a case where the node is disposed at the side of the plated surface of the base material, and where a convex part protruding toward the anode is provided on the plated surface, electric current tends to concentratedly flow from the anode toward the vicinity of the apex of the convex part. As the curvature of the convex part is increased, this tendency further increases. However, with the aforementioned configuration, the distance from each part of the plated surface to the anode increases with increase in the curvature of the convex part protruding to the anode at each part of the plated surface. Thus, electric current flowing from the anode to the plated surface is suppressed from concentratedly flowing in the vicinity of the apex of the convex part. Consequently, electric current uniformly flows from the anode to all parts of the plated surface. Thus, with the aforementioned configuration, the electric current density can be more uniformed at all parts of the plated surface. Consequently, a metal film can evenly and uniformly be formed on the plated surface. Incidentally, in the aforementioned configuration, the flat part of the plated surface is regarded as a convex part having a curvature of "0".

According to another aspect of the invention, there is provided a method (hereunder referred to as a second method of the invention) for fabricating a plate product by disposing an anode at the side of a surface of a base material, which is to be plated, and performing electroplating on the surface of the base material so as to form a metal film on said plated surface. The second method of the invention has a gist in that the anode is disposed so that at the electroplating, a distance from each part of the plated surface to the anode decreases with increase in a curvature of a concave part which is formed on each part of the plated surface so as to be away from the anode.

In a case where the anode is disposed at the side of the plated surface, and where the plated surface has a concave part formed so as to be away from the anode, electric current tends to concentratedly flow from the anode to the vicinity of the inlet portions of the concave part. In a case where the curvature of the concave part is increased, this tendency is increased. However, according to the second method of the invention, the distance from each part of the plated surface to the anode is decreased with increase in a curvature of a concave part that is formed on each part of the plated surface so as to be away from the anode. Thus, electric current flowing from the anode to the plated surface is suppressed from concentratedly flowing in the vicinity of each of the inlet portions of the concave part. Consequently, electric current uniformly flows from the anode to all parts of the plated surface. Thus, with the aforementioned configuration, the electric current density can be more uniformed at all parts of the plated surface. Consequently, a metal film can evenly and uniformly be formed on the plated surface. Incidentally, in the aforementioned configuration, the flat part of the plated surface is regarded as a concave part having a curvature of "0".

According to another aspect of the invention, there is provided a method (hereunder referred to as a third method of the invention) for fabricating a plate product by disposing an anode at the side of a surface of a base material, which is to be plated, and performing electroplating on the surface of the base material so as to form a metal film on the plated surface. The third method of the invention has a gist in that at the electroplating, the anode is disposed so as to face a medial part of the base material, which part is other than parts having a predetermined width of end portions of the plated surface.

In a case where the anode is disposed so as to face all parts including end portions of the plated surface of the base material in a state in which the anode and the base material are made to face each other, because the repulsion of forces represented by electric flux lines, which are directed to the plated surface from the anode, in the vicinity of the end portions of the plated surface is small, a "path" of each electric flux line is broad, so that the current density is likely to be high. However, with the aforementioned configuration, the anode is prevented from facing the part having the predetermined width of the end portions of the plated surface. Thus, the current density at the end portions of the plated surface can be prevented from being high, as compared with that at each of the other portions thereof. Incidentally, electric current flows to the end portions of the plated surface from the end portions of the anode that faces the medial part of the plated surface. Accordingly, with the aforementioned configuration, the electric current density can be more uniformed at all parts of the plated surface. Consequently, a metal film can evenly and uniformly be formed on the plated surface.

An embodiment (hereunder referred to as a fourth method of the invention) of one of the first to third methods of the invention has a gist in that the anode includes a stick-like-anode configured so that a distance to the anode from each part of the plated surface is changed by forming a stick-like soluble metal into a shape corresponding to a shape of the plated surface.

With the aforementioned configuration, by forming a stick-like copper material into a shape corresponding to the shape of the plated surface through a processing method that can easily be performed, e.g., a press molding method, the distance from each part of the plated surface to the anode can be changed. In a case where the stick-like anode is dissolved and reduced in size by electroplating, the replacement of the anode itself can be performed with small effort by, e.g., detaching the anode from an electrode of the electrically conducting device for electroplating, and attaching a new anode thereto.

An embodiment (hereunder referred to as a fifth method of the invention) of one of the first to fourth methods of the invention has a gist in that the anode includes a plurality of segmented-anodes electrically connected to an electrically conducting device for electroplating.

With the aforementioned configuration, optional manners of the anode can be employed by, e.g., forming the segmented-anode like a stick, or constituting the anode by the block-anodes housed in the case. Further, the configuration arrangement of the segmented-anodes can appropriately be changed according to the shape of the plated surface of a plated product, using the segmented-anodes in such a manner.

An embodiment (hereunder referred to as a sixth method of the invention) of the fifth method of the invention has a gist in that a voltage to be applied between said base material and each of said plurality of segmented-anodes by said electrically conducting device is set individually corresponding to said segmented-anodes.

With the aforementioned configuration, a voltage to be applied between the base material and each segmented anode can be individually set. Thus, the electric current density at each part of the plated surface can be more uniformed by appropriately setting such a voltage.

An embodiment (hereunder referred to as a seventh method of the invention) of the fifth or sixth method of the invention has a gist in that at least one of the plurality of segmented-anodes is configured so that a plurality of block anodes made of a soluble metal are housed in a case made of an insoluble metal, and that the case is electrically connected to the electrically conducting device for electroplating, and has an opening portion opened in a part provided at the side of the plated surface.

With the aforementioned configuration, the block anode is electrically connected to the electrically conducting device through the case. At electroplating, the metal ions of the block anode dissolve into a plating solution and flows out of the opening portion of the case. Then, the metal is deposited on the plated surface. Thus, a metal film is formed. Even when the block anode is dissolved and reduced in size by electroplating, a new block anode can be replenished into the case. Thus, the block anodes can be exhausted without waste, and the case can be reused.

Meanwhile, an anode of the type configured to house block anodes in a relatively large case, whose size is comparable to that of, e.g., a base material, has hitherto been utilized, instead of the segmented anodes. However, in a case where a part of the block anodes dissolves when a certain time has elapsed since the start of the electroplating, the remaining block anodes may be biased in position in the case. Thus, the anode of this type has a drawback in that the distance from each part of the base material to each block anode is changed from a value at the start of electroplating. However, in the case of using segmented anodes, each of the cases is formed so as to have a relatively small size. Additionally, plural cases are appropriately disposed according to the shapes of the plated surfaces. Accordingly, even in a case where the block anodes are biased in position in the case, the distance from each part of the base material to the block anode is not largely changed from a value at the start of electroplating due to the positional bias of the block anode.

An embodiment (hereunder referred to as an eighth method of the invention) of the seventh method of the invention has a gist in that the case has a pressing member for pressing the block anode against an inner wall of the case.

With the aforementioned configuration according to the eighth method of the invention, the block anode is pressed against the inner wall of the case. Thus, the block anode can surely be put into contact with the case. That is, at electroplating, the block anode is dissolved and reduced in size. However, because the contact point between the block anode and the case is assured in this way, a state, in which the block anode is electrically connected to the electrically conducting device, can be maintained. Accordingly, at electroplating, the metal of the block anode is surely resolved. Thus, a metal film can be formed on the plated surface.

The method for fabricating a plated product according to the invention can more surely uniform, in a case where a metal film is formed on a product's surface to be plated by electroplating, the thickness of a metal film to be formed on the plated surface of the product.

BRIEF DESCRIPTION OF THE DRAWINGS

FIG. 2A is a front view illustrating the configuration arrangement of the base material and the first to the segmented anodes. FIG. 2B is a cross-sectional view taken on line A-A shown in FIG. 2A.

FIG. 3A illustrates the first segmented anode. FIG. 3B illustrates the second segmented anode. FIG. 3C illustrates the third segmented anode. FIG. 3D illustrates the fourth segmented anode.

FIG. 5A illustrates a case where a plated surface of the base material is convexly formed. FIG. 5B illustrates a case where a plated surface of a base material is concavely formed.

FIG. 10A illustrates a case where an extra width X is set at a width X1. FIG. 10B illustrates a case where the extra width X is set at a width X2.

FIG. 11 is a table showing the thickness of the metal film formed by electroplating in the method for fabricating a plated product according to the third embodiment of the invention.

DESCRIPTION OF THE PREFERRED EMBODIMENTS

First Embodiment

Hereinafter, a first embodiment of the invention, which is an application of a method for fabricating a plated product according to the invention to a method for fabricating a vehicle bumper molding, is described with reference to FIGS. 1 to 6.

Figure 1:
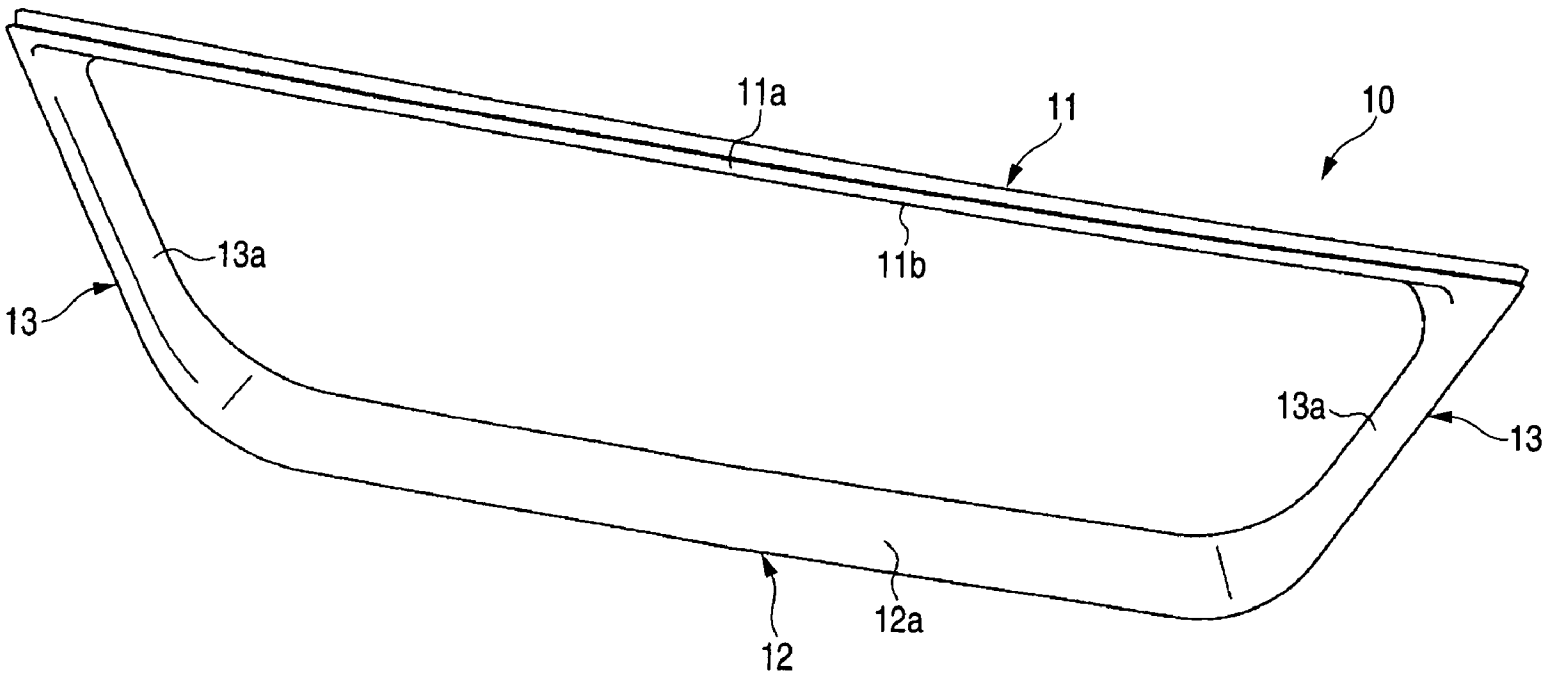
FIG. 1 is a perspective view illustrating a bumper molding to be fabricated by a fabricating method therefor according to a first embodiment of the invention.

FIG. 1 illustrates a bumper molding 10. The bumper molding 10 constitutes an outer frame of a front grille provided between a hood and a front bumper and between a pair of headlights in a front portion of a vehicle (not shown). As illustrated in FIG. 1, the bumper molding 10 is a laterally long trapezoidal shape annular frame body having a part that is exposed in a state in which the bumper molding 10 is provided in the vehicle, and that is plated with copper. In the state in which the bumper molding 10 is provided in the vehicle, the bumper molding 10 is constituted by integrally forming an upwardly-positioned top frame portion 11, a downwardly-positioned bottom frame portion 12, and side frame portions 13, each of which connects an associated end of the top frame portion 11 to an associated end of the bottom frame portion 12, with one another. The top frame portion 11 has a top-frame front surface 11*a* that is directed to the front of the vehicle in the state in which the bumper molding 10 is provided in the vehicle, and has also a top-frame bottom surface 11*b* that is directed to the bottom of the vehicle in such a state (FIG. 1 illustrates only the front ends thereof). The bottom-frame portion 12 has a bottom-frame surface 12*a* that is directed to the front of the vehicle and is upwardly inclined in a direction from the front to the rear of the vehicle in the state in which the bumper molding 10 is provided in the vehicle. Incidentally, the bottom-frame surface 12*a* is formed so as to be larger in width than each of the top-frame front surface 11*a* and the top-frame bottom surface 11*b*. Each of the side-frame portions 13 has a side-frame surface 13*a* which is directed to the inner side of the frame body and which is inclined inwardly toward the rear side of the vehicle. The side-frame surface 13*a* is formed continuously from the top-frame bottom surface 11*b* of the top-frame portion 11 and from the bottom-frame surface 12*a* of the bottom-frame portion 12. In the bumper molding 10, the top-frame front surface 11*a*, the top-frame bottom surface 11*b*, the bottom-frame surface 12*a*, and the side-frame surfaces 13*a* are exposed in the state in which the bumper molding 10 is provided in the vehicle. Copper plating is performed on the surfaces 11*a*, 11*b*, 12*a*, and 13*a*.

Hereinafter, a method for fabricating the bumper molding 10 by performing copper plating on a surface of a base material thereof, which is to be plated with copper, is described.

Figure 2A:
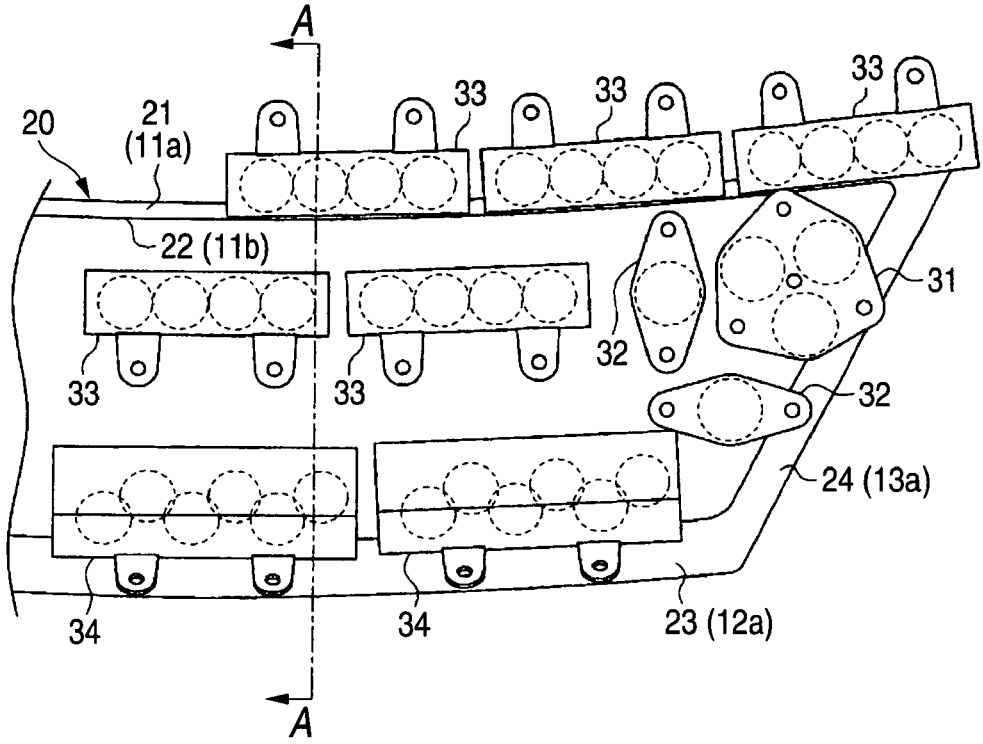
FIGS. 2A and 2B illustrate the configuration arrangement of a base material for electroplating and first to fourth segmented anodes, which are used in the method of fabricating a bumper molding according to the first embodiment of the invention.
Figure 2B:
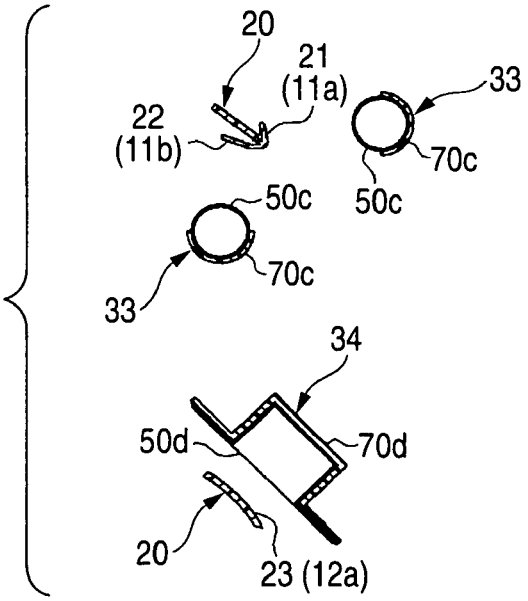

FIGS. 2A and 2B illustrate the configuration arrangement of a base material 20, which is a material of the bumper molding 10, and four kinds of segmented anodes, i.e., first to fourth segmented anodes 31 to 34 in a plating solution for electroplating. Surfaces of the base material 20 shown in FIG. 2, which are to be plated and which respectively correspond to the top-frame front surface 11*a*, the top-frame bottom surface 11*b*, the bottom-frame surface 12*a*, and the side frame surfaces 13*a* of the bumper molding 10, are a first plated surface 21, a second plated surface 22, a third plated surface 23, and a fourth plated surface 24. The base material 20 is formed of an acrylonitrile butadiene styrene (ABS) resin. The base material 20 is coated with a nickel layer by performing electro-less plating, after minute concavities and convexities are formed on surfaces of the base material 20. When electroplating is performed thereon, a voltage is applied between the base material 20 and each of the segmented anodes 31 to 34. Thus, the base material 20 serves as a cathode. Each of the segmented anodes 31 to 34 serves as an anode corresponding to the base material 20.

FIGS. 3A to 3D are views respectively illustrating the segmented anodes 31, 32, 33, and 34. As illustrated in FIGS. 3A to 3D, each of the segmented anodes 31, 32, 33, and 34 are constituted so that block anodes 60 made of copper, which is a soluble metal, are housed in an associated one of metal cases 50*a* to 50*d* made of titanium that is an insoluble metal. The metal cases 50*a* to 50*d* are respectively covered with resin cases 70*a* to 70*d*, each of which is made of a resin material.

Hereinafter, the configuration of each of the segmented anodes 31 to 34 is described in detail.

Figures 3A, 3B, 3C, 3D:
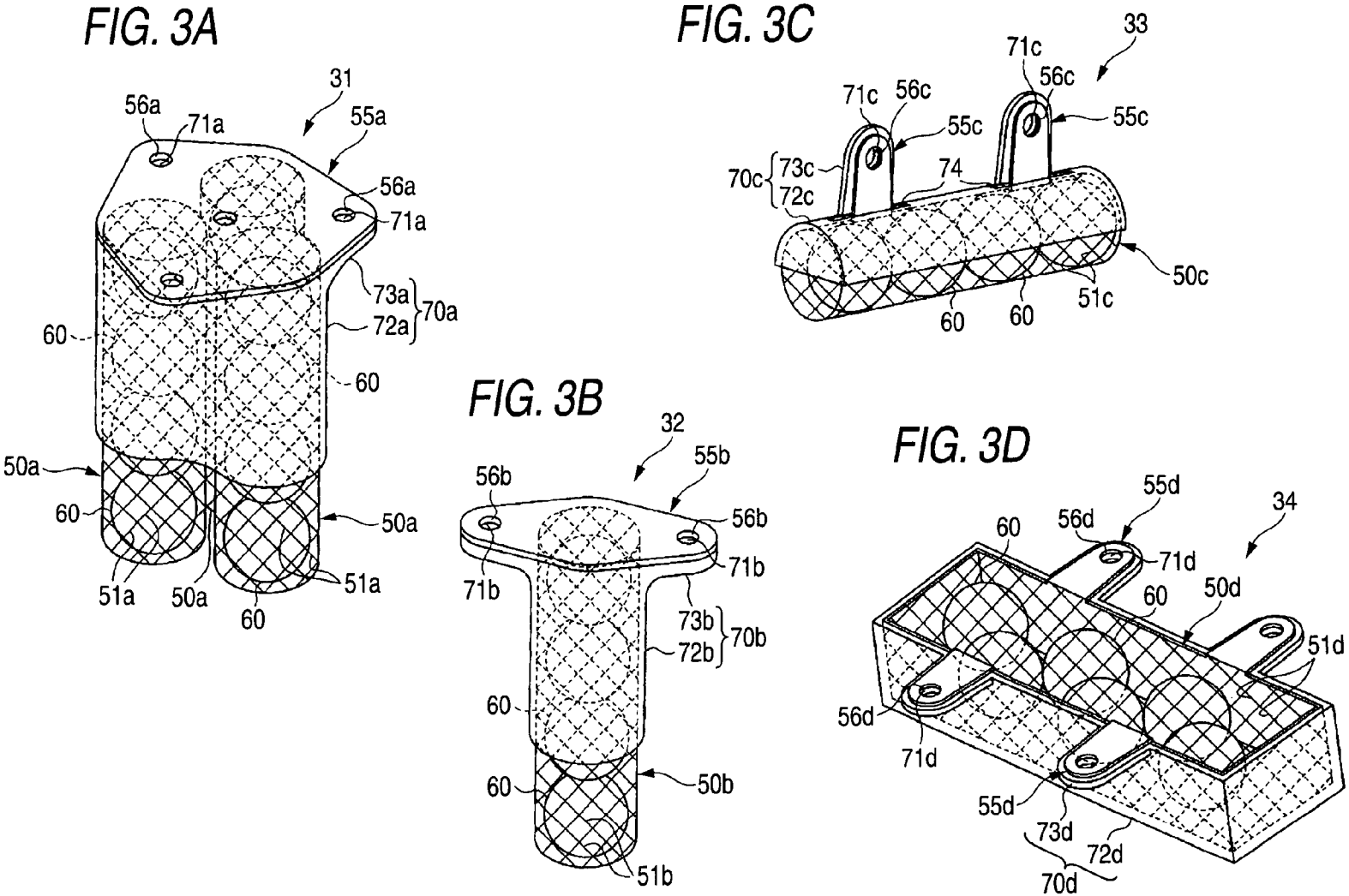
FIGS. 3A to 3D are perspective views respectively illustrating the first to fourth segmented anodes.

As illustrated in FIG. 3A, the first segmented anode 31 has three hollow metal cases 50*a* each of which is formed like a cylinder elongated in the direction of an axis thereof. The entire peripheral surface of each of the metal cases 50*a*, is constituted by a metal mesh. According to the present embodiment, plural (e.g., four, as viewed in FIG. 3A) block anodes 60 formed of metal balls are housed in each of the metal cases 50*a*. In the first segmented anode 31, the three metal cases 50*a* are bundled so that the axes of the cases 50*a* are parallel to one another. In this state, a plate-like metal flange 44*a* is attached to the three metal cases 50*a*. The metal flange 55*a* is attached to the bottom surface of each of the metal cases 50*a* so that the rear surface of the metal flange 55*a* faces one of the metal cases 50*a* in a state in which the three metal cases 50*a* are bundled. The first segmented anode 31 is such that a substantially half part of each of the metal cases 50*a*, which part is closer to the metal flange 55*a*, is covered with a substantially cylindrical resin case 70*a* in the state in which the three metal cases 50*a* are bundled, and that the other substantially half part of each of the metal cases 50*a*, which part is opposite to a side at which the metal flange 55*a* is attached to the metal cases 50*a*, is exposed. At electroplating, the exposed substantially-half part of each of the three metal cases 50*a* is placed in the vicinity of the border between the second plated surface 22 and the fourth plated surface 24 of the base material 20. Openings 51*a* in the metal mesh of the exposed part of each of the metal cases 50*a* constitute an opening portion opened in a part at the side of each of the plated surfaces 22 and 24 of the base material 20. More specifically, the resin case 70*a* has a case body 72*a*, which covers the periphery of each of the metal cases 50*a*, and a flange portion 73*a* formed along the rear surface of the metal flange 55*a*. Attaching holes 56*a* and 71*a* are formed at positions corresponding to spaces among the metal cases 50*a* and penetrate through the metal flange 55*a* and the flange portion 73*a* of the resin case 70*a*.

As illustrated in FIG. 3B, the second segmented anode 32 has one metal case 50*b* having the same configuration as that of the metal case 50*a* of the first segmented anode 31. In the second segmented anode 32, plural (e.g., four, as viewed in FIG. 3B) block anodes 60 formed of metal balls are housed in the metal case 50*b*. A metal flange 55*b* is attached to the metal case 50*b* so that the rear surface of the plate-like metal flange 55*b* is brought into contact with the bottom surface of the metal case 50*b*. The second segmented anode 32 is such that the peripheral surface of a substantially half part of the metal case 50*b*, which part is closer to the metal flange 55*b*, is covered with a substantially cylindrical resin case 70*b*, and that the other substantially half part of each of the metal cases 50*a*, which part is opposite to a side at which the metal flange 55*b* is attached to the metal case 50*b*, is exposed. At electroplating, the exposed part of the metal case 50*b* is placed at the side of each of the second plated surface 22 and the fourth plated surface 24 of the base material 20. Openings 51*b* in the metal mesh of the exposed part of the metal case 50*b* constitute an opening portion opened in a part at the side of each of the plated surfaces 22 and 24 of the base material 20. More specifically, the resin case 70*b* has a case body 72*b*, which covers the periphery of the metal case 50*b*, and a flange portion 73*b* formed along the rear surface of the metal flange 55*b*. Attaching holes 56*b* and 71*b* are formed so as to penetrate through the metal flange 55*b* and the flange portion 73*b* of the resin case 70*b*.

As illustrated in FIG. 3C, the third segmented anode 33 has one metal case 50*c* having the same configuration as those of the metal case 50*a* of the first segmented anode 31 and the metal case 50*b* of the first segmented anode 32. In the third segmented anode 33, plural (e.g., four, as viewed in FIG. 3C) block anodes 60 formed of metal balls are housed in the metal case 50*c*. Two plate-like metal flanges 55*c* are attached to the peripheral surface of the metal case 50*c* in a manner in which the metal flanges 55*c* are arranged in the direction of an axis of the metal case 50*c*. The third segmented anode 33 is such that in a case where the metal case 50*c* is divided by a plane, which includes an axis of the case 50*c*, into two parts, a substantially half part thereof at a side, to which the metal flange 55*c* is attached, is covered with a resin case 70*c*. The opposite substantially-half part of the metallic case 50*c* is exposed. That is, a substantially semicircle part of each of the top surface and the bottom surface of the metal case 50*c* and a substantially-half part of the peripheral surface corresponding to the substantially semicircle part are exposed. The metal case 50*c* is such that the exposed parts are placed at the sides of the first plated surface 21 and the second plated surface 22 of the base material 20. Openings in the metal mesh of each of the exposed parts of the metal case 50*c* constitute an opening portion opened in a part at the side of each of the plated surfaces 21 and 22 of the base material 20. More specifically, the resin case 70*c* has a case body 72*c*, which covers the periphery of the metal case 50*c*, and a flange portion 73*c* formed along the rear surface of the metal flange 55*c*. Attaching holes 56*c* and 71*c* are formed so as to penetrate through the metal flange 55*c* and the flange portion 73*c* of the resin case 70*c*.

As illustrated in FIG. 3D, the fourth segmented anode 34 has one metal case 50*d* formed like a laterally long substantially-rectangular parallelepiped. In the fourth segmented anode 34, plural (e.g., six, as viewed in FIG. 3C) block anodes 60 formed of metal balls are housed in the metal case 50*d*. Two plate-like metal flanges 55*d* are attached to each of the long sides of one of the top surface and the bottom surface of the metal case 50*d* at positions respectively opposed to those of two plate-like metal flanges 55*d* attached to the other long side. In the fourth segmented anode 34, all surfaces other than the one of the top surface and the bottom surface of the metal case 50*d* are covered with the substantially-rectangular parallelepiped resin case 70*c*. That is, the metal case 50*d* is such that the one of the top surface and the bottom surface is exposed, that the one of the top surface and the bottom surface is placed at the side of the third plated surface 23 of the base material 20 at electroplating, and that openings 51*d* in the reticulations of the metal mesh of the one of the top surface and the bottom surface constitute an opening portion opened in a part at the side of the third plated surface 23 of the base material 20. More specifically, the metal case 50*d* has a case body 72*d*, which covers the remaining five surfaces of the metal case 50*d*, and covers also a flange portion 73*d* formed along the metal flange 55*d*. Attaching holes 56*d* and 71*d* are formed so as to penetrate through the metal flange 55*d* and the flange portion 73*d* of the resin case 70*d*.

The first to fourth segmented anodes 31 to 34 configured in the aforementioned manner are placed with respect to the base material 20 in the plating solution, as illustrated in FIGS. 2A and 2B. Incidentally, although drawing is omitted, the base material 20 is supported in the plating solution by a support member (not shown) and is electrically connected to the cathode of an electrically conducting device. Additionally, although drawing is omitted, the segmented anodes 31 to 34 are supported by engaging the attaching holes 56*a* to 56*d* of the metal flanges 55*a* to 55*d* and the attaching holes 71*a* to 71*d* of the flange portions 73*a* to 73*d* of the resin cases 70*a* to 70*d* with the support member in the plating solution. Each of the metal flanges 55*a* to 55*d* is electrically connected to the anode of the electrically conducting device.

More specifically, as illustrated in FIG. 2A, the first segmented anode 31 is such that the three metal cases 50*a* are disposed corresponding to the border portion between the second plated surface 22 and the fourth plated surface 24 and to peripheral parts thereof as follows. That is, the first segmented anode 31 is such that one of the three metal cases 50*a* corresponds to the border portion between the second plated surface 22 and the fourth plated surface 24, that another of the three metal cases 50*a* corresponds to the second plated surface 22, and that the remaining one of the three metal cases 50*a* corresponding to the fourth plated surface 24. Additionally, the first segmented anode 31 is such that parts, which are not covered with the resin case 70*a* and are exposed, face the plated surfaces 22 and 24 in each of the metal cases 50*a*.

As illustrated in FIG. 2A, the second segmented anodes 32 are disposed on both sides of the first segmented anode 31, respectively, so that one of the second segmented anodes 32 corresponds to the second plated surface 22, and that the other second segmented anode 32 corresponds to the fourth plated surface 24. The metal case 50*b* of the second segmented anode 32 is such that parts thereof, which are not covered with the resin case 70*a* and are exposed, face the plated surfaces 22 and 24, respectively.

As illustrated in FIGS. 2A and 2B, a plurality of the third segmented anodes 33 are arranged in the direction of an axis of the metal case 50*c* along each of the first plated surface 21 and the second plated surface 22. Additionally, the third segmented anode 33 is such that parts thereof, which are not covered with the resin case 70*c* and are exposed, face the plated surfaces 21 and 22. Incidentally, the third segmented anodes 33 disposed corresponding to the second plated surface 22, as illustrated in FIG. 2B, are placed on a more rear side of paper, on which FIGS. 2A and 2B are drawn, than the base material 20.

As illustrated in FIGS. 2A and 2B, the fourth segmented anodes 34 are such that a plurality of the metal cases 50*d* of the fourth segmented anodes 34 are arranged in the longitudinal direction along the third plated surface 23. The fourth segmented anode 34 is such that one of the top surface and the bottom surface of the metal case 50*d*, which is not covered with the resin case 70*c* and is exposed, face the third plated surface 23.

Thus, according to the present embodiment, four kinds of the segmented anodes 31 to 34, which differ in shape from one another, are appropriately placed so as to face the plated surfaces 21 to 24 of the base material 20. That is, parts of the segmented anodes 31 to 34 differ in shape from one another. For example, among the plated surfaces 21 to 24, the third plated surface 28 is a relatively wide surface. On the other hand, the border between the second plated surface 22 and the fourth plated surface 24 is a concave part. However, the four kinds of the segmented anodes 31 to 34 are appropriately disposed according to the shapes of the parts.

When the power supply for the electrically conducting device is "ON" in a state in which the segmented anodes 31 to 34 are disposed with respect to the base material 20, the block anodes 60 provided in the metal cases 50*a* to 50*d* are energized therethrough. The metal cases 50*a* to 50*d* are made of titanium which is an insoluble metal, so that titanium does not dissolve into a plating solution. The block anode 60 is made of copper which is a soluble metal. Thus, copper ions flow in a plating solution through the openings 51*a* to 51*d* of the metal cases 50*a* to 50*d*. Copper having flowed in the plating solution is deposited on the plated surfaces 21 to 24 of the base material 20. Thus, a metal film is formed. Then, minute concavities and convexities formed on the surfaces of the base materials are flattened when a metal film is deposited on the plated surfaces 21 to 24. Also, a relatively thin layer made of nickel or the like is formed on the surfaces after the metal film made of copper is formed thereon.

Figure 4:
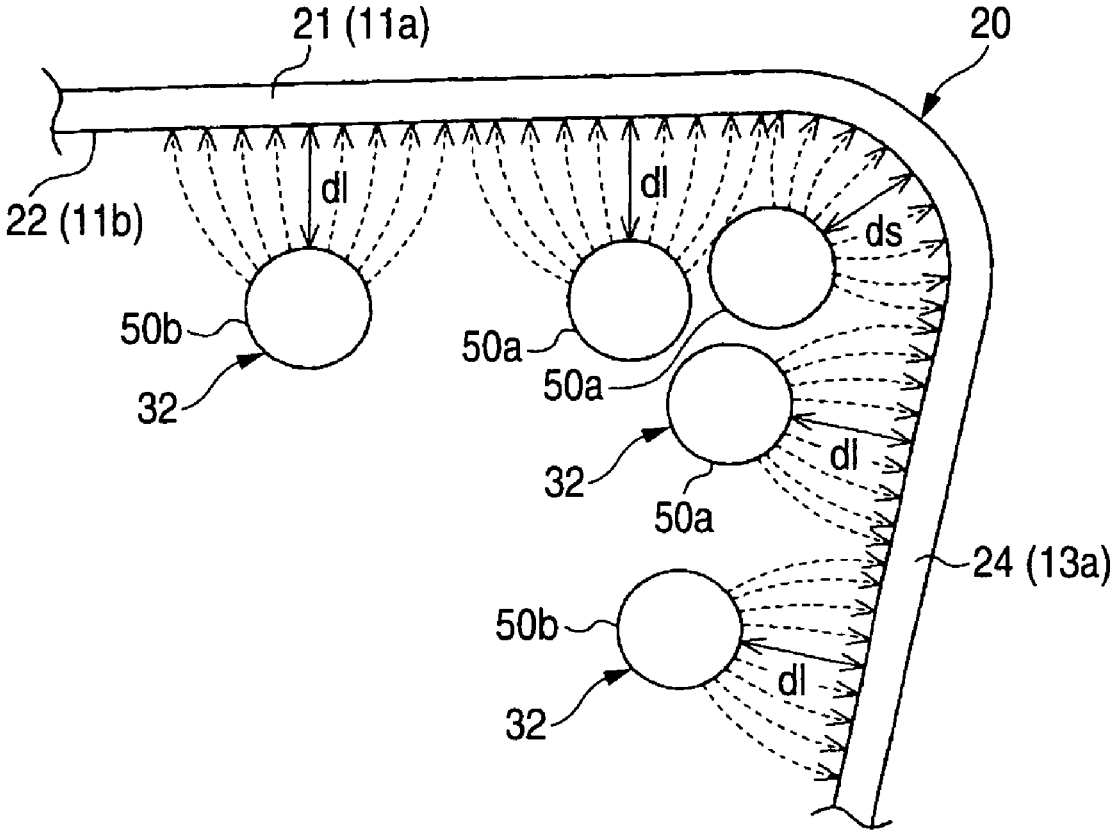
FIG. 4 is a schematic view illustrating the distance between a base material of a bumper molding and an anode, which is set at electroplating, in a method for fabricating a bumper molding according to the first embodiment of the invention.

Meanwhile, according to the present invention, the distances between the metal cases 50*a* to 50*d* and the plated surfaces 21 to 24 are set as follows. FIG. 4 schematically illustrates the setting of these distances. Incidentally, FIG. 4 shows only the first segmented anodes 31 and the second segmented anodes 32.

As illustrated in FIG. 4, the first segmented anodes 31 are disposed at the border portion between the second plated surface 22 and the fourth plated surface 24 and the periphery of the border portion. A distance to the border portion from the metal case 50*a* corresponding to the border portion is set at a length ds. Distances from each of the other metal cases 50*a* to the second plated surface 22 and the fourth plated surface 24 are set at a length d1 that is longer than the length ds. A distance from the metal case 50*b* of the second segmented anode 32 to the second plated surface 22 and a distance from through the metal case 50*b* of the second segmented anode 32 to the fourth plated surface are set at the length d1 that is longer than the length ds. Although drawing is omitted, distances from each of the metal case 50*c* of the third segmented anode 33 and the metal case 50*d* of the fourth segmented anode 34 to the first through third plated surface 21 through 23 are set at, e.g., the length d1. Incidentally, the length d1 is not necessarily constant. It is sufficient that the length d1 is longer than the length ds.

Figure 5A:
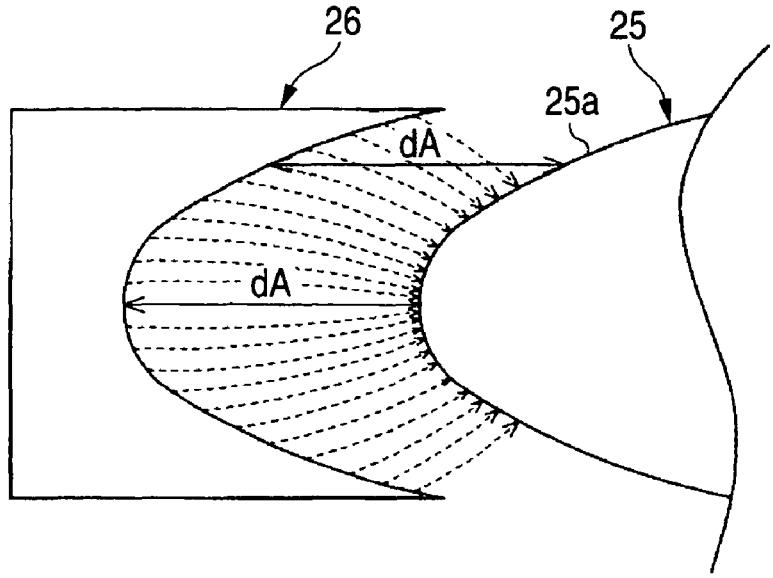
FIGS. 5A and 5B are side views illustrating the configuration arrangement of a base material and an anode at electroplating in a conventional method for fabricating a plated product.
Figure 5B:
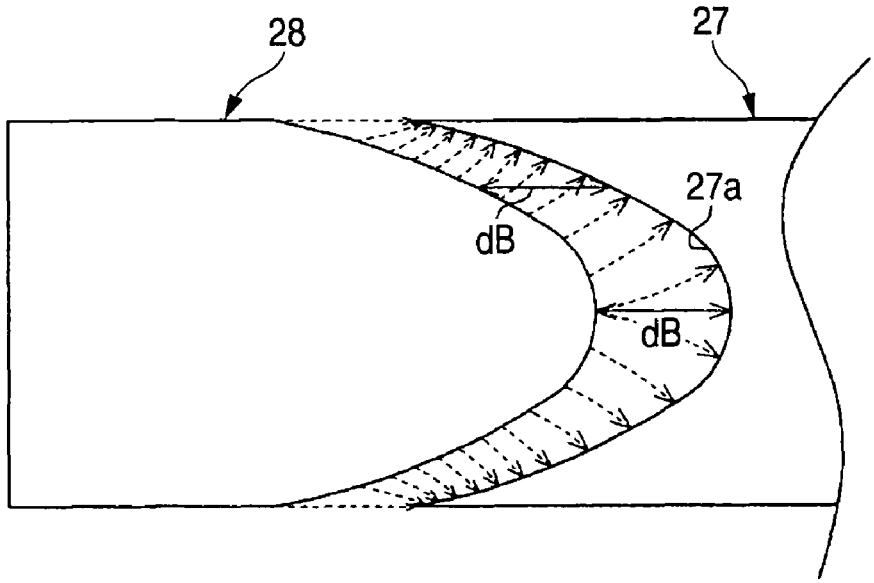

The reason for setting the distances between the metal cases 50*a* to 50*d* and the plated surfaces 21 to 24 according to the present embodiment is that the following problems have hitherto been present in a case where convexities and concavities are formed on the plated surfaces of the base material. FIGS. 5A and 5B illustrate the configuration arrangement of a base material, which serves as a cathode in a plating solution for conventional electroplating, and an anode. Incidentally, in FIGS. 5A and 5B, arrows represented with dashed lines designate electric flux lines directed from anodes 26 and 28 to a plated surface 25*a* of a base 25 and a plated surface 27*a* of a base material 27.

Plating is performed on the plated surface 25*a* formed as a convexly curved surface, the center of which is protruded relative to peripheral parts, of the base material 25 shown in FIG. 5A by electroplating. The anode 26 is disposed at the side of the plated surface 25*a* of the base material 25. A distance from the anode 26 to each part of the plated surface 25*a* of the base material 25 is set at a distance dA that is constant in a direction in which the base material 25 and the anode 26 are arranged. In this case, electric current flowing from the anode 26 to the plated surface 25*a* of the base material 25 is not uniform at each part of the plated surface 25*a* and is concentrated near the center of the plated surface 25*a* largely protruded relative to the peripheral parts thereof, as indicated by the electric flux lines that are represented by dashed lines. That is, in a case where a convex portion is formed on the plated surface, an electric current density tends to be high in the vicinity of the apex of the convex portion. Thus, the electric current density tends to be high in the vicinity of the center of the plated surface 25*a* of the base material 25 shown in FIG. 5A. Accordingly, the metal film formed on the base material 25 tends to be thick in the vicinity of the center of the plated surface 25*a*, in comparison with the current density at each of the peripheral parts thereof, and also tends to be thinned toward each peripheral part of the plated surface 25*a* of the base material 25 from the center thereof. In a case where the anode is disposed so that the constant distance dA is maintained as the distance between the anode and each part of the plated surface of the base material in a direction in which the base material and the anode are arranged, the unevenness of the thickness of the metal film increases with increase in the curvature of the convex portion of the base material.

Plating is performed on the plated surface 27*a* formed as a concavely curved surface, the center of which is protruded relative to peripheral parts, of the base material 27 shown in FIG. 5B by electroplating. The anode 28 is disposed at the side of the plated surface 27*a* of the base material 27 so that a distance from the anode 28 to each part of the plated surface 27*a* of the base material 25 is maintained at a distance dB that is constant in a direction in which the base material 27 and the anode 28 are arranged. In this case, electric current flowing from the anode 28 to the plated surface 27*a* of the base material 27 is not uniform at each part of the plated surface 27*a* and is concentrated on both end parts of the plated surface 27*a*, as indicated by the electric flux lines that are represented by dashed lines. That is, in a case where a concave portion is formed on the plated surface, an electric current density tends to be high in the vicinity of the inlet portions (i.e., both end parts) of the concave portion. Thus, the electric current density tends to be high in the vicinity of both end parts of the plated surface 27*a* of the base material 27 shown in FIG. 5B and to be low at the center (i.e., the bottom part) of the plated surface 27*a*. Accordingly, the metal film formed on the plated surface 27*a* tends to be thick in the vicinity of both end parts of the plated surface 27*a*, in comparison with the current density at the center thereof, and also tends to be thinned toward the bottom part of the plated surface 27*a* from each end part of the plated surface 27*a* of the base material 27. In a case where the anode is disposed so that the constant distance dB is maintained as the distance between the anode and each part of the plated surface of the base material in a direction in which the base material and the anode are arranged, the unevenness of the thickness of the metal film increases with increase in the curvature of the concave portion of the base material.

Figure 6:
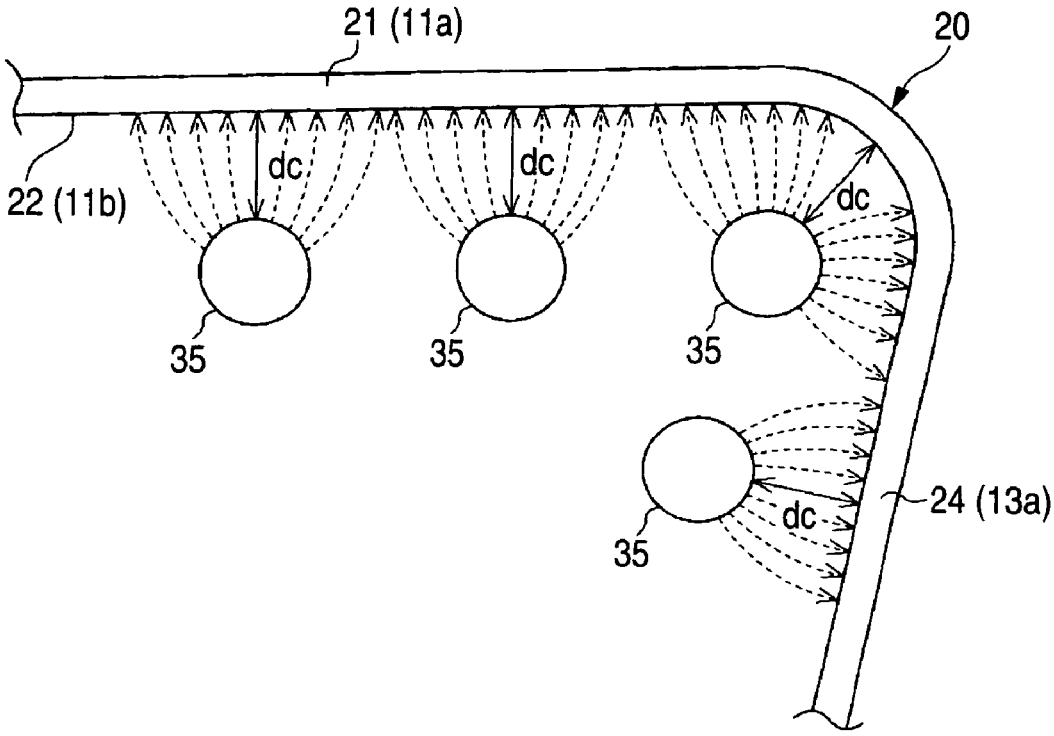
FIG. 6 is a schematic view illustrating the distance between a base material and an anode, which are used at electroplating in a conventional method for fabricating a bumper molding.

In a case where plating is performed on the base material 20 in the conventional configuration arrangement shown in FIGS. 5A and 5B, a configuration arrangement illustrated in FIG. 6 can also be considered. That is, the border portion between the second plated surface 22 and the fourth plated surface 24 of the second the base material 20 serving as the material of the bumper molding 10 is curved. Thus, this portion can be regarded as a concave portion. In this case, when the anode and the base material are placed so that the distance from each of the segmented anodes 35 to each of the plated surfaces 21 through 24 of the base material 20 is a constant length dc, as illustrated in FIG. 6, the density of electric current flowing from the segmented anode 35 to each of the plated surfaces 21 through 24 is high in the vicinity of each of approach parts of the concave portion serving as the border portion and is low at the bottom part of the concave portion. That is, the bumper molding 10 fabricated in this way tends to be uneven in thickness so that the metal film formed at the border portion between the second plated surface 22 and the fourth plated surface 24 is relatively thin, and that the thickness of the other parts of the plated surfaces is relatively thick. In this respect, according to the present embodiment, one of the metal cases 50*a* of the first segmented anode 31 is disposed closer to the border portion between the second plated surface 22 and the fourth plated surface 24 than the other metal cases 50*a*. Consequently, the metal film formed on the border portion serving as the bottom part of the concave portion can be prevented from becoming thinner than that formed on the other parts of the plated surfaces. That is, according to the aforementioned method for fabricating the bumper molding 10, the thickness of the metal film formed on the plated surface 21 of the base material 20 can surely be uniformed with a simple configuration. Also, the anode including the first segmented anode 31 to the fourth segmented anode 34 is disposed so that at electroforming, the distance from each of parts of the plated surfaces 21 through 24 to the anode decreases with increase in the curvature of the concave portion formed at each part of the plated surfaces 21 through 24 so as to be away from the anode. Thus, the thickness of the metal film can appropriately be uniformed according to the curvature of the concave portion formed at each part of the plated surfaces 21 through 24.

The present embodiment uses a plurality of segmented anodes 31 to 34 instead of a single anode. Therefore, even when the block anodes 60 contained in the metal cases 50*a* to 50*d* dissolve and are reduced in size by performing electroplating, electric current can be maintained by replenishing new block anodes 60 into the cases 50*a* to 50*d*. Thus, the present embodiment has advantages in that the block anodes can be exhausted without waste, and that the cases 50*a* to 50*d* can be reused. The anode can be placed relatively close to each part of the plated surfaces 21 to 24, using the segmented anodes 31 to 34. Accordingly, a time required to perform electroplating can be reduced, as compared with a time needed in the case of using a large anode that is comparable in size to a product.

When several hours have elapsed since the start of metal-plating, the block anodes 60 can be biased in position in the metal cases 50*a* to 50*d*. However, according to the present embodiment, each of the segmented anodes 31 to 34 is formed so as to be small in comparison with the base material 20. The plural metal cases 50*a* to 50*d* are appropriately disposed according to the shapes of the plated surfaces 21 to 24. Accordingly, according to the present embodiment, even when several hours have elapsed since the start of metal-plating, the distance to the block anode 60 from each part of the plated surfaces 21 through 24 of the base material 20 does not largely change since the start of electroplating, as compared with the conventional case where the block anodes 60 are housed in the metal cases that are relatively large. Incidentally, according to the present embodiment, the distance between the block anode 60 and each part of the plated surfaces 21 through 24 of the base material 20 can be made to be unchanged as much as possible since the start of electroplating. For example, in a case where the segmented anodes 31 to 34 are placed above the plated surfaces 21 to 24 of the base material 20, the block anodes 60 housed in the metal cases 50*a* to 50*d* are always placed to the sides of the plated surfaces 21 to 24 due to gravity. In this case, the distances between the block anodes 60 and the placed surfaces 21 to 24 are maintained at substantially constant values since the start of electroplating. Additionally, in a case where pressing members for pressing the block anodes 60 against inner walls of the metal cases 50*a* to 50*d*, in each of which an associated one of openings 51*a* to 51*d* is formed, are provided in the metal cases 50*a* to 50*d*, the distance between the plated surfaces 21 to 24 and the block anodes 60 can be maintained to be constant. Incidentally, in a case where such a pressing member is provided in each of the metal cases, even when the block anodes 60 dissolve and are reduced in size by electroplating, the block anodes 60 are pushed by the pressing members against the inner walls of the metal cases 50*a* to 50*d*. Thus, the contact points between the block anodes 60 and the metal cases 50*a* to 50*d* can be assured. Accordingly, a state, in which the block anodes 60 are electrically connected to the electrically conducting device, can surely be maintained.

As described above in detail, the present embodiment can have the following advantages (1) to (3).

(1) In the method for fabricating the bumper molding 10 according to the present embodiment, electroplating is performed by disposing the anode, which includes the first to fourth segmented-anodes 31 to 34, at the side of each of the plated surfaces 21 to 24 of the base material 20. Further, at the electroplating, the anode including the first to fourth segmented-anodes 31 to 34 is disposed so that the distance to the anode from each part of the plated surfaces 21 through 24 decreases with increase in the curvature of the concave portion formed at each part of the plated surfaces 21 to 24 so as to be away from the anode. Consequently, the density of electric current flowing from the anode to each of the plated surfaces 21 to 24 of the base material 20 can be made to be substantially uniform. Thus, the present embodiment can prevent occurrence of the unevenness of the thickness of the metal film formed by electroplating, e.g., the phenomenon that the thickness of the metal film formed at the inlet part of the concave portion in the vicinity of the border portion between the plated surfaces 22 and 24 is large, in comparison with the thickness of the metal film formed at the bottom part of the concave portion. That is, the metal film can evenly and uniformly be formed at all parts of the plated surfaces 21 to 24.

(2) In accordance with the method for fabricating the bumper molding 10 according to the present invention, the anode includes a plurality of the segmented anodes 312 to 34 connected to the electrically conducting device. Consequently, the segmented anodes 31 to 34 can appropriately be disposed according to the shapes of the plated surfaces 21 to 24 of the base material 20 serving as the material of the bumper molding 10. Also, because the segmented anodes 31 to 34 are formed so as to be small, in comparison with the base material 20, the segmented anodes 31 to 34 can easily be disposed by being placed to the placed surfaces 21 to 24, as compared with the conventional case of using the anode whose size is comparable to the size of the base material. Consequently, a time required to perform electroplating can be reduced, as compared with the conventional case.

The anode according to the present embodiment includes the four kinds of the segmented anodes 31 to 34 that differ in shape from one another. Consequently, the segmented anodes are disposed so as to face the plated surfaces 21 to 24. Accordingly, convenience can be further enhanced.

(3) In accordance with the method for fabricating the bumper molding 10 according to the present invention, the segmented anodes 31 to 34 are such that a plurality of the block anodes 60 made of copper are housed in each of the metal cases 50*a* to 50*d* made of titanium. The metal cases 50*a* to 50*d* are electrically connected through the metal flanges 55*a* to 55*d* to the electrically conducting device for electroplating. The metal cases 50*a* to 50*d* have mesh openings 51*a* to 51*d* in the parts at the sides of the plated surfaces 21 to 24 of the base material 20. Consequently, the block anodes 60 are electrically connected to the electrically conducting device through each of the cases. At electroplating, the copper of the block anodes 60 dissolves into a plating solution as copper ions, and flows out of the openings 51*a* to 51*d* of the metal cases 50*a* to 50*d*. The copper is deposited on the plated surfaces 21 to 24. Accordingly, a metal film is formed thereon. Even when the block anodes 60 dissolve and are reduced in size by performing electroplating, electric current can be maintained by replenishing new block anodes 60 into the metal cases 50*a* to 50*d*. The block anodes can be exhausted without waste, and the cases 50*a* to 50*d* can be reused.

According to the present embodiment, the segmented anodes 31 to 34 formed so as to be small in comparison with the base material 20 are used in order to implement the use of an anode of the type housing the block anodes in the metal cases. Thus, the segmented anodes 31 to 34 are appropriately disposed therein according to the shapes of the plated surfaces 21 to 24. Consequently, even in a case where the block anodes 60 are biased in position in the metal case 50*a* when several hours have elapsed since the start of electroplating, the distances from each part of the plated surfaces 21 through 24 to the block anodes 60 do not largely change, as compared with those at the start of electroplating.

Second Embodiment

Figure 7:
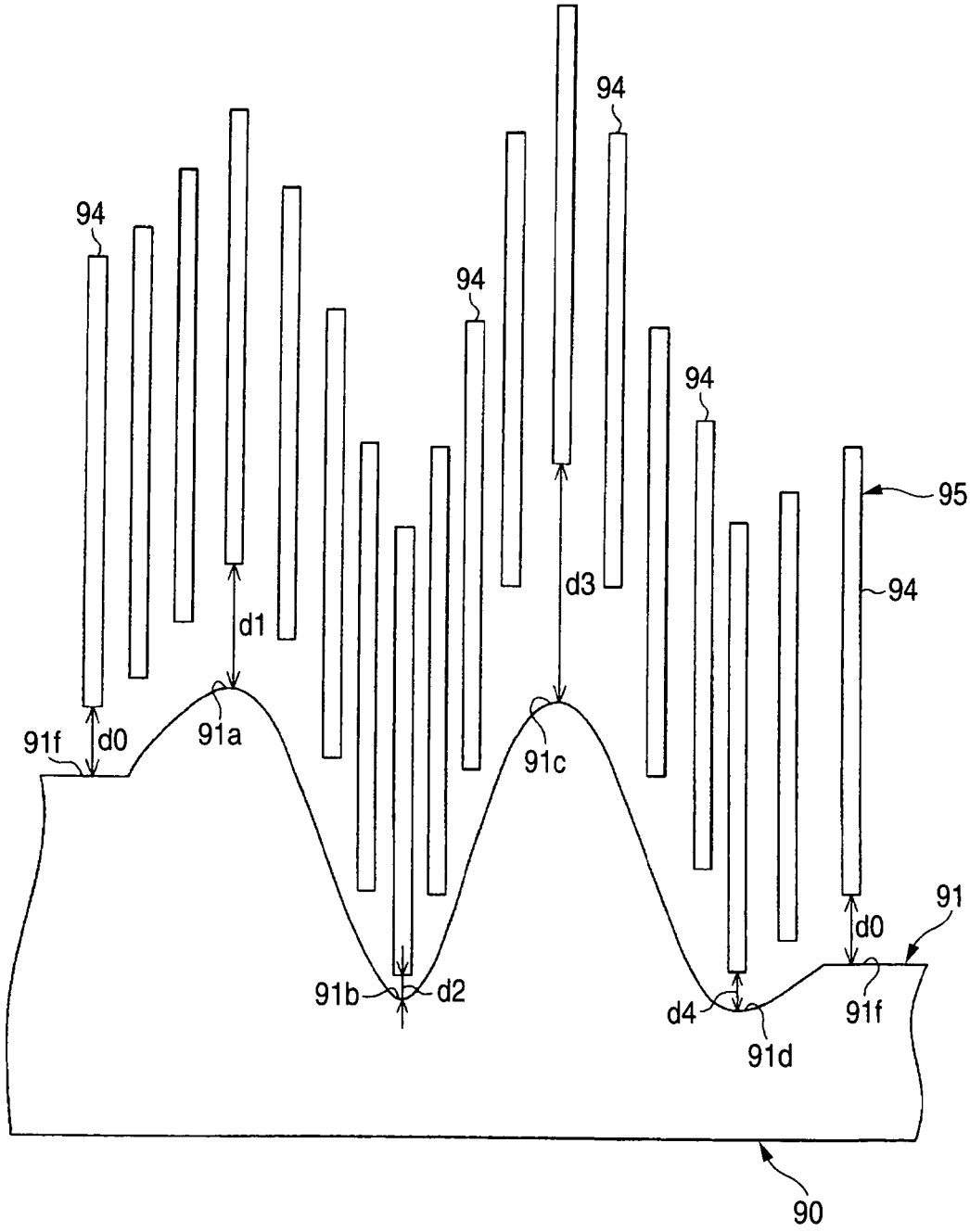
FIG. 7 is a side view illustrating the configuration arrangement of a base material and an anode at electroplating in a method for fabricating a plated product according to a second embodiment of the invention.

Hereinafter, a second embodiment that implements a method for fabricating a plated product according to the invention is described below with reference to FIG. 7. FIG. 7 is a side view illustrating a configuration arrangement of a base material 90, which serves as a cathode in a plating solution for electroplating, and an anode 95. Incidentally, although drawing is omitted, a voltage is applied between the base material 90 and the anode 95 in a plating solution for electroplating. Incidentally, the base material 90 is formed of an ABS resin, similarly to the base material 20. The base material 90 is coated with a nickel layer by performing electro-less plating, after minute concavities and convexities are formed on surfaces of the base material 90.

As illustrated in FIG. 7, according to the present embodiment, the anode 95 is disposed so as to face a plated surface 91 of the base material 90. The plated surface 91 of the base material 90 has two flat portions 91*f* formed flat, and convex portions 91*a* and 91*c*, which project to the anode 95, and has also concave portions 91*b* and 91*d* concavely formed so as to be away from the anode 95. More specifically, the plated surface 91 has a first convex portion 91*a* having a relatively small curvature, a second convex portion 91*c* having a relatively large curvature, a first concave portion 91*b* having a relatively large curvature, and a second concave portion 91*d* having a relatively small curvature.

The anode 95 according to the present embodiment includes a plurality of (e.g., 18, as viewed in FIG. 7) segmented anodes 94. The segmented anodes 94 are formed so as to have the same shape like a stick. Incidentally, in a case where a metal film made of, e.g., copper is coated on the base material 90, the segmented anodes 94 can be made of copper that is a soluble metal. Alternatively, the segmented anodes 94 can be made of an insoluble metal. In addition, copper, which is a soluble metal, can be dissolved into a plating solution.

According to the present embodiment, the segmented anodes 94 are disposed with respect to the base material 90. More specifically, as illustrated in FIG. 7, the separation distance between each flat portion 91*f* formed on the plated surface 91 and the segmented anode 94 corresponding to this flat portion 91*f* is set at a length d0. Similarly to the first embodiment illustrated in FIG. 5A, in a case where a convex portion is formed on a plated surface, an electric current density is high in the vicinity of the apex of the convex portion. Thus, the separation distances between the convex portions 91*a* and 91*c* of the plated surface 91 and the segmented anodes 94 respectively corresponding to the convex portions 91*a* and 91C are set at lengths d1 and d3 that are longer the length d0. Further, in the convex portions 91*a* and 91*c*, the curvature of the second convex portion 91*c* is larger than that of the first convex portion 91*a*. Accordingly, the separation distance d3 between the second convex portion 91*c* and the segmented anode 94 is set to be longer than that d1 between the first convex portion 91*a* and the segmented anode 94. Incidentally, the curvature of a convex portion of each of the flat portions 91*f* can be regarded to be "0".

On the other hand, in a case where a concave portion is formed on a plated surface, as described in the foregoing description of the first embodiment with reference to FIG. 5B, an electric current density is high in the vicinity of each inlet part of the concave portion, while the electric current density is low at the bottom part of the concave portion. Thus, the separation distances between the concave portions 91*b* and 91*d* of the plated surface 91 and the segmented anodes 94 respectively corresponding to the concave portions 91*b* and 91*d* are set at lengths d2 and d4 that are shorter than the length d0. Furthermore, in the concave portions 91*b* and 91*d*, the curvature of the first concave portion 91*b* is larger than that of the second convex portion 91*d*. Accordingly, the separation distance d2 between the first concave portion 91*b* and the segmented anode 94 is set to be shorter than that d4 between the second concave portion 91*d* and the segmented anode 94. Incidentally, the curvature of a concave portion of each of the flat portions 91*f* can be regarded to be "0".

As described above in detail, the second embodiment can have the advantage (1) of the first embodiment and the following advantages (4) and (5).

(4) In the method for fabricating a plated product according to the second embodiment, electroplating is performed by disposing the anode 95, which includes the segmented anodes 94, at a side opposite to the plated surface 91 of the base material 90. At electroplating, each of the segmented anodes 94 is disposed so that the distances form each part of the plated surface 91 to the segmented anodes 94 increase with increase in the curvature of each of the convex portions 91*a*, 91*c*, and 91*f*, which project to the anode 95, at each part of the plated surface. Accordingly, the density of electric current flowing from the anode 95 to each part of the plated surface 91 of the base material 90 can be made to be substantially uniform. Consequently, the present embodiment can prevent occurrence of the unevenness of the thickness of the metal film formed by electroplating, e.g., the phenomenon that the thickness of the metal film formed in the vicinity of the top part of the convex portion on the plated surface 91 is large, in comparison with the thickness of the metal film formed at the other parts of the convex portion. That is, the metal film can evenly and uniformly be formed at all parts of the plated surface 91.

(5) In accordance with the method for fabricating a plated product according to the present embodiment, the anode 95 includes a plurality of the segmented anodes 94. Consequently, the segmented anodes 94 can appropriately be disposed according to the shape of the plated surface 91 of the base material 90.

Third Embodiment

Figure 8:
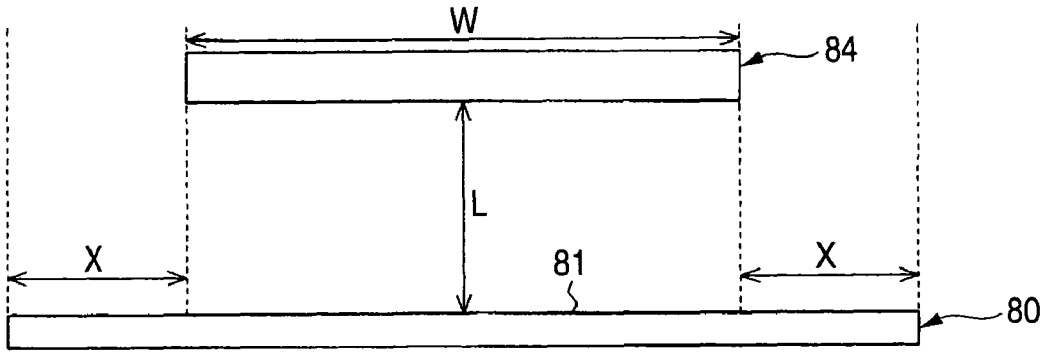
FIG. 8 is a side view illustrating the configuration arrangement of a base material and an anode at electroplating in a method for fabricating a plated product according to a third embodiment of the invention.

Hereinafter, a third embodiment that implements a method for fabricating a plated product according to the invention is described below with reference to FIGS. 8 to 11. FIG. 8 is a side view illustrating a configuration arrangement of a base material, which serves as a cathode in a plating solution for electroplating, and an anode. According to the present embodiment, as illustrated in FIG. 8, each of a base material 80 and an anode 84 is formed like a substantially rectangular plate. The anode 84 is disposed so as to face a flat plated surface 81 of the base material 80. Further, according to the present embodiment, the width of the anode 84 is set at a plate width W so that the anode 84 faces a medial part of the base material 80, which part is located in the middle of the base material 80 and is other than each part that extends from an associated one of both ends of the base material 80 and that has a predetermined extra width X. Incidentally, although FIG. 8 illustrates a side view of the base material 80 and the anode 84, the anode 84 faces the medial part, which is located in the middle of the base material 80 and is other than each part that extends from an associated one of both ends of the base material 80 and that has a predetermined extra width X, in the direction of a rear side of paper, on which FIG. 8 is drawn. In the present embodiment, the base material 80 is made of metal, such as iron or aluminum.

Figure 9B:
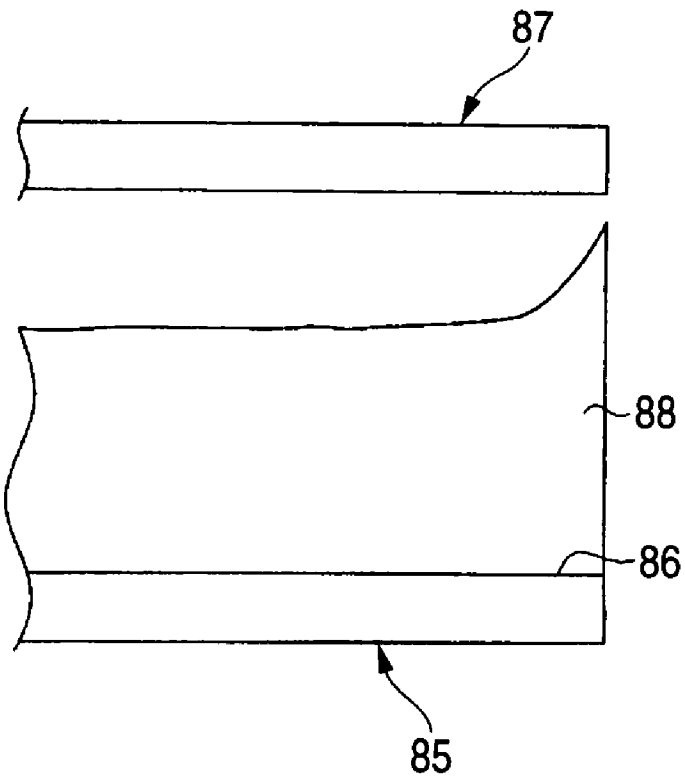
FIG. 9B is a side view exaggeratingly illustrating a metal film formed by electroplating that is performed in the manner illustrated in FIG. 9A.
Figure 9A:
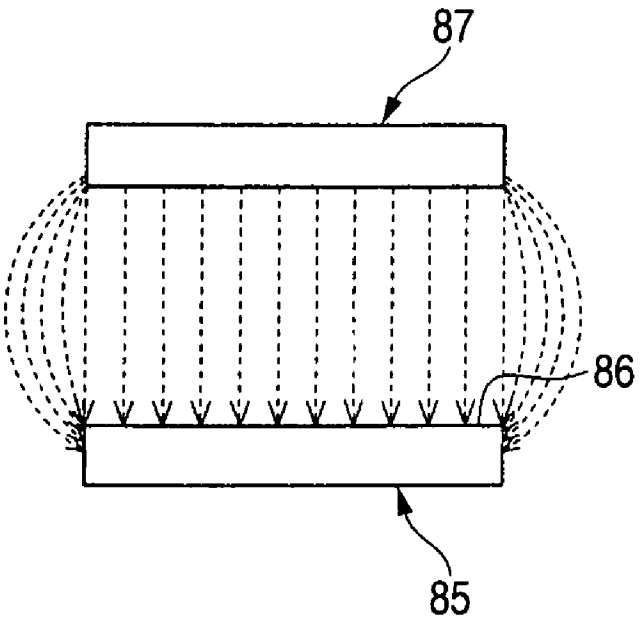
FIG. 9A is a side view illustrating the configuration of a base material and an anode at electroplating in a conventional method for fabricating a plated product.

Meanwhile, hitherto, as illustrated in FIG. 9A, at electroplating, an anode 87 is disposed so as to face all parts of a base material 85, which includes end portions of a plated surface 86, in a state in which the anode 87 faces the base material 85. Electric flux lines in this configuration arrangement are now studied, which are directed to the plated surface 86 of the base material 85 from the anode 87 and are represented by arrowed dash lines shown in FIG. 9A. In a space extending above a central portion of the plated surface 86, as viewed in FIG. 9A, the repulsion of forces represented by the flux lines is large. However, in a space extending above each end portion of the plated surface 86, as viewed in FIG. 9A, the repulsion of forces represented by the flux lines is small. Thus, apparently, a "path" of each electric flux line is broad in the space extending above each end portion of the plated surface 86. That is, in this configuration arrangement, there is a tendency that the current density in the space extending above each end portion of the plated surface 86 is high, as compared with that in the space extending above the central portion thereof. Accordingly, as illustrated in FIG. 9B, a metal film 88 formed on the plated surface 86 of the base material 85 is extremely thick at a part corresponding to each end portion of the plated surface 86 and becomes gradually thinner towards the central portion of the surface 86. Thus, the metal film has a certain constant thickness at the central portion of the surface 86. Incidentally, for easily understanding the degree of the unevenness of the thickness of the metal film, FIG. 9B and FIG. 10, which will be described later, illustrates the metal film 88 by exaggerating the thickness thereof.

Thus, according to the present embodiment, the anode 84 is disposed so as to face the medial part of the base material 80, which part is located in the middle of the base material 80 and is other than each part that extends from an associated one of both ends of the base material 80 and that has a predetermined extra width X, as illustrated in FIG. 8. In this case, electric current flows from the end portions of the anode, which faces the medial part of the plated surface, to the end portions of the plated surface 81 of the base material 80. Accordingly, plating is performed on the end portions of the plated surface 81.

Figure 10B:
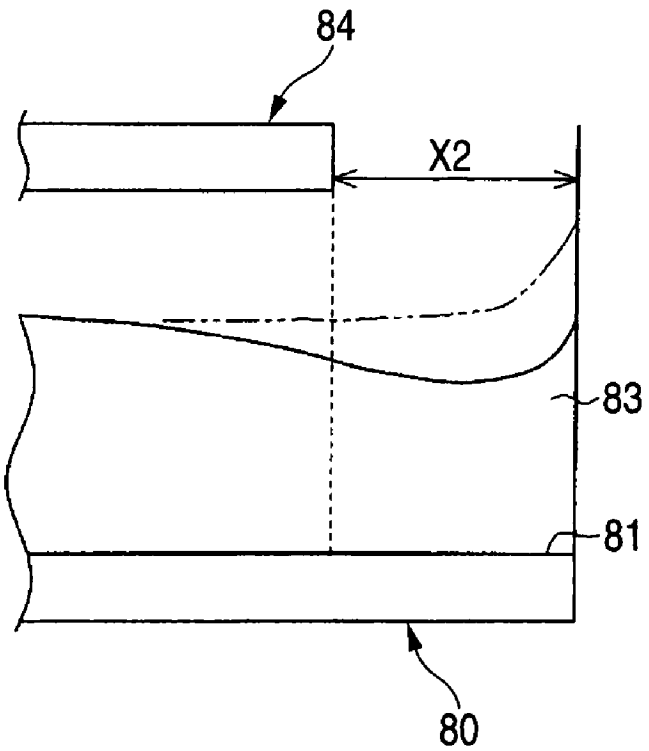
FIGS. 10A and 10B are side views exaggeratingly illustrating a metal film formed by electroplating in a method for fabricating a plated product according to a third embodiment of the invention.
Figure 10A:
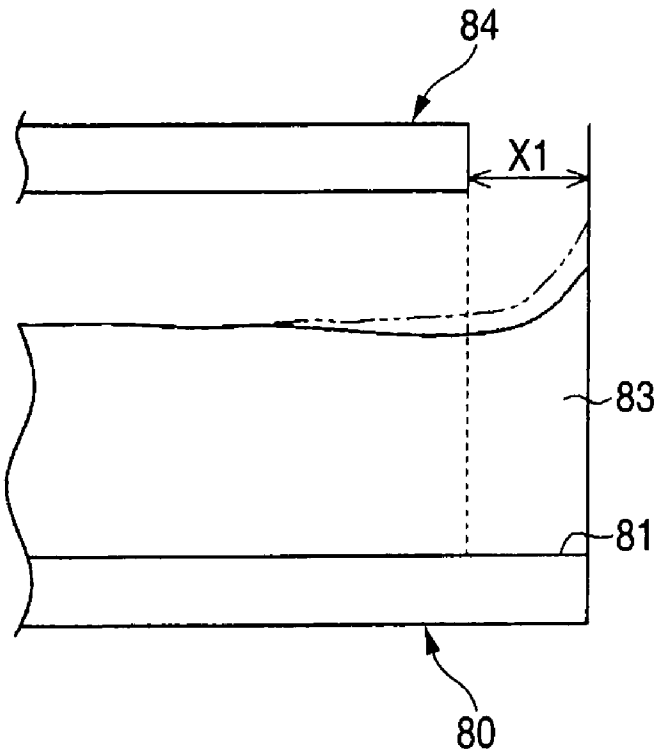

FIGS. 10A and 10B illustrate a metal film in a case where the extra width X is appropriately set. In FIGS. 10A and 10B, a double-dashed chain line represents the metal film in a case where the anode illustrated in FIG. 9B is disposed so as to correspond to the end portions of the plated surface. For example, in a case where the extra width X is set at a width X1, as illustrated in FIG. 10A, the metal film 83 formed on the plated surface 81 by electroplating can be prevented from being extremely thick at a part corresponding to each of the end portions of the plated surface 81. Further, in a case where the extra width X is set to be a width X2 that is larger than the width X1, as illustrated in FIG. 10B, the metal film formed on the plated surface 81 by electroplating can be made to have a substantially same thickness at each of the central portion and the end portions thereof.

Hereinafter, a result of an experiment of electroplating conducted by the inventors of the present invention by disposing the anode 84 so as to face only the medial part other than the end parts of the plated surface 81 is described below with reference to FIG. 11. FIG. 11 shows the thickness of the metal film formed by performing electroplating in a case where the distance L between the anode 84 and the base material 80 illustrated in FIG. 8 was set at 50 mm, 30 mm, 20 mm, and 10 mm, where the width of the plated surface 81 was set at 100 mm, and where the plate width of the anode 84 was set at 100 mm and values smaller than 100 mm.

First, results of the experiment in the case of setting the distance L between the anode 84 and the base material 80 at 50 mm are described below. As shown in FIG. 11, Sample A corresponds to electroplating performed in a case where the distance L was 50 mm, where the plate width W of the anode 84 was set at 100 mm, which was equal to the width of the surface of the base material 80, and where the anode 84 faced the entire plated surface 81 of the base material 80. Sample B corresponds to electroplating performed in a case where the distance L was 50 mm, where the extra width X and the plate width W of the anode 84 were respectively set at 40 mm and 20 mm, and where the anode 84 faced a medial part of the plated surface 81 of the base material 80, which part was located to the center of the plate surface 81 by 20 mm from each of the end parts of the plated surface 81.

As shown in FIG. 11, in the case of Sample A, the maximum value of the film thickness of the metal film 83 was 32.36 mm. The minimum value of the film thickness of the metal film 83 was 17.92 mm. A ratio of the maximum value to the minimum value was 181%. Additionally, in the case of Sample A, the central-position film thickness was 17.92 mm that was the minimum value. The film thickness at each of the end parts was 32.36 mm that was the maximum value. Thus, the film thickness at the end parts was extremely large. On the other hand, in the case of Sample B, the maximum value of the film thickness of the metal film 83 was 28.04 mm. The minimum value of the film thickness of the metal film 83 was 18.66 mm. A ratio of the maximum value to the minimum value was 150%. Further, in the case of Sample B, the central-position film thickness of the metal film 83 was 20.93 mm. The film thickness of each of the end parts was 28.04 mm. Thus, in the case of Sample B, the film thickness of the metal film 83 was not extremely large. The ratio of the maximum value to the minimum value was reduced by 31%, as compared with that in the case of Sample A, in which the extra width X is 0 mm.

Results of the experiment in the case of setting the distance L between the anode 84 and the base material 80 at 30 mm were as follows. As shown in FIG. 11, Sample C corresponds to electroplating performed in a case where the distance L was 30 mm, where the plate width W of the anode 84 was set at 100 nm that was equal to the width of the surface of the base material 80, and where the anode 84 was made to face the entire plated surface 81 of the base material 80. Sample D corresponds to electroplating performed in a case where the distance L was 30 mm, where the plate width W of the anode 84 was set at 60 nm by setting the extra width X corresponding to the anode 84 at 20 mm, and where the anode 84 faced a medial part of the plated surface 81 of the base material 80, which part was located to the center of the plate surface 81 by 60 mm from each of the end parts of the plated surface 81.

As shown in FIG. 11, in the case of Sample C, the maximum value of the film thickness of the metal film 83 was 29.31 mm. The minimum value of the film thickness of the metal film 83 was 19.35 mm. A ratio of the maximum value to the minimum value was 151%. Additionally, in the case of Sample C, the central-position film thickness was 19.35 mm that is the minimum value. The film thickness at each of the end parts was 29.31 mm that was the maximum value. On the other hand, in the case of Sample D, the maximum value of the film thickness of the metal film 83 was 23.73 mm. The minimum value of the film thickness of the metal film 83 was 18.80 mm. A ratio of the maximum value to the minimum value was 126%. Further, in this condition, the central-position film thickness of the metal film 83 was 22.73 mm. The film thickness of each of the end parts was 23.73 mm. Thus, in the case of Sample D, the film thickness of the metal film 83 was not extremely large. The ratio of the maximum value to the minimum value was reduced by 25%, as compared with that in the case of Sample C, in which the extra width X is 0 mm.

Results of the experiment in the case of setting the distance L between the anode 84 and the base material 80 at 20 mm were as follows. As shown in FIG. 11, Sample E corresponds to electroplating performed in a case where the distance L was 20 mm, where the plate width W of the anode 84 was set at 100 nm that was equal to the width of the surface of the base material 80, and where the anode 84 was made to face the entire plated surface 81 of the base material 80. Sample F corresponds to electroplating performed in a case where the distance L was 20 mm, where the plate width W of the anode 84 was set at 80 nm by setting the extra width X corresponding to the anode 84 at 10 mm, and where the anode 84 faced a medial part of the plated surface 81 of the base material 80, which part was located to the center of the plate surface 81 by 80 mm from each of the end parts of the plated surface 81.

As shown in FIG. 11, in the case of Sample E, the maximum value of the film thickness of the metal film 83 was 26.40 mm. The minimum value of the film thickness of the metal film 83 was 20.41 mm. A ratio of the maximum value to the minimum value was 129%. Additionally, in the case of Sample E, the central-position film thickness was 20.41 mm that is the minimum value. The film thickness at each of the end parts was 29.31 mm that was the maximum value. On the other hand, in the case of Sample F, the maximum value of the film thickness of the metal film 83 was 23.02 mm. The minimum value of the film thickness of the metal film 83 was 19.55 mm. A ratio of the maximum value to the minimum value was 118%. Further, in the case of Sample F, the central-position film thickness of the metal film 83 was 22.30 mm. The film thickness of each of the end parts was 23.02 mm. Thus, in the case of Sample F, the film thickness of the metal film 83 was not extremely large. The ratio of the maximum value to the minimum value was reduced by 11%, as compared with that in the case of Sample E, in which the extra width X is 0 mm.

Additionally, results of the experiment in the case of setting the distance L between the anode 84 and the base material 80 at 10 mm were as follows. As shown in FIG. 11, Sample G corresponds to electroplating performed in a case where the distance L was 10 mm, where the plate width W of the anode 84 was set at 100 nm that was equal to the width of the surface of the base material 80, and where the anode 84 was made to face the entire plated surface 81 of the base material 80. Sample H corresponds to electroplating performed in a case where the distance L was 10 mm, where the plate width W of the anode 84 was set at 96 nm by setting the extra width X corresponding to the anode 84 at 2 mm, and where the anode 84 faced a medial part of the plated surface 81 of the base material 80, which part was located to the center of the plate surface 81 by 96 mm from each of the end parts of the plated surface 81.

As shown in FIG. 11, in the case of Sample G, the maximum value of the film thickness of the metal film 83 was 23.03 mm. The minimum value of the film thickness of the metal film 83 was 21.55 mm. A ratio of the maximum value to the minimum value was 107%. Additionally, in the case of Sample G, the central-position film thickness was 21.80 mm. The film thickness at each of the end parts was 23.03 mm that was the maximum value. On the other hand, in the case of Sample H, the maximum value of the film thickness of the metal film 83 was 22.02 mm. The minimum value of the film thickness of the metal film 83 was 21.06 mm. A ratio of the maximum value to the minimum value was 105%. Further, in the case of Sample H, the central-position film thickness of the metal film 83 was 22.20 mm. The film thickness of each of the end parts was 21.63 mm. Thus, in the case of Sample H, the film thickness of the metal film 83 was not extremely large. The ratio of the maximum value to the minimum value was reduced by 2%, as compared with that in the case of Sample G, in which the extra width X is 0 mm.

As is understood from the above results, the present embodiment can have the following advantage (6).

(6) In accordance with the method for fabricating a plated product according to the present embodiment, a metal film 83 is formed on the plated surface 81 of the base material 80 by disposing the node 84 at the side of the plated surface 81 of the base material 80 and performing electroplating. Further, at electroplating, the anode 84 is disposed so as to face the medial part, which is other than each part that extends from an associated one of both ends of the plated surface 81 and that has a predetermined extra width X. Thus, the anode 84 is made not to face the part of each of the end portions of the placed surface 81, which part has the extra width X. Consequently, the present embodiment can prevent the current density at each of the end portions of the plated surface from being higher than that at the remaining parts of the plated surface. Accordingly, the current density can be more uniformed at all parts of the plated surface 81. That is, as is understood from the results of the experiment, the ratio of the maximum value of the metal film 83 to the minimum value thereof can be made to be relatively small. Thus, the film thickness of the metal film 83 can be more uniformed.

Fourth Embodiment

Hereinafter, a fourth embodiment that implements a method for fabricating a plated product according to the invention is described below with reference to FIGS. 12 to 14. In the following description of the fourth embodiment, a method for performing copper plating on a base material 20 serving as the material of the bumper molding is described, similarly to the description of the first embodiment.

Figure 12A:
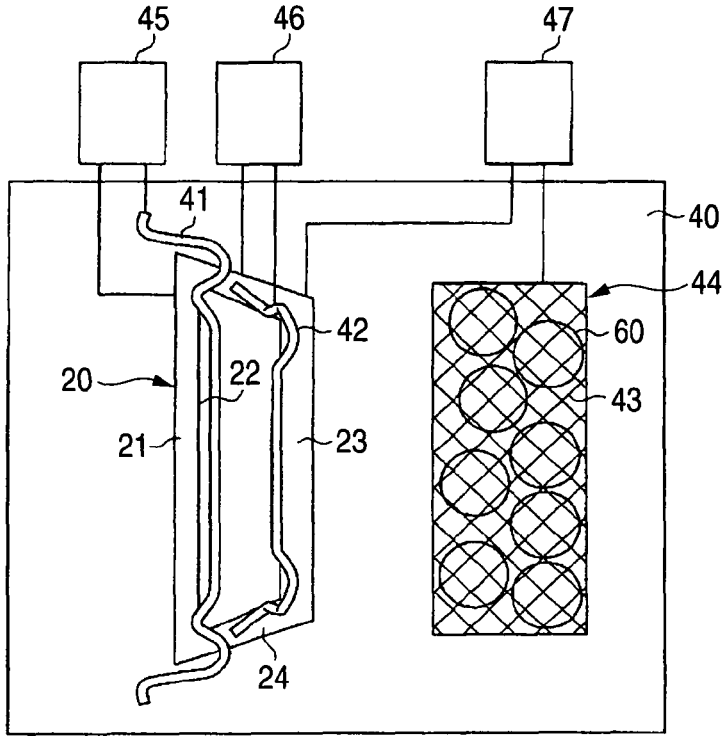
FIGS. 12A and 12B are schematic views illustrating the configuration arrangement of a base material and an anode at electroplating in a method for fabricating a plated product according to a fourth embodiment of the invention.
Figure 12B:
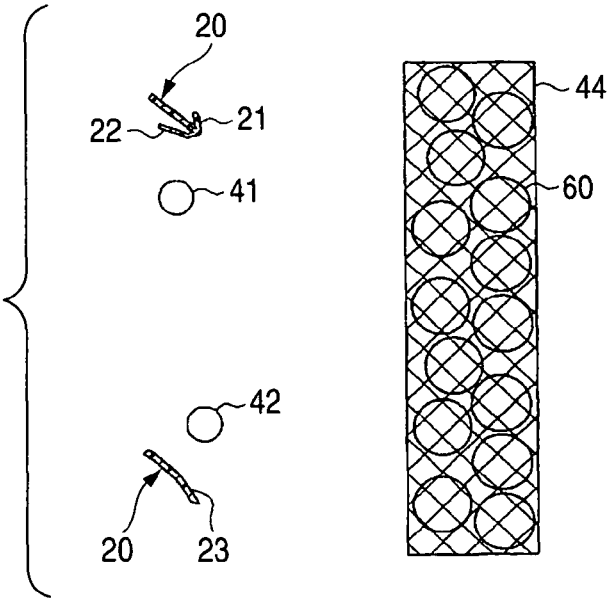

FIGS. 12A and 12B are views schematically illustrating a configuration arrangement of the base material 20 and segmented anodes 41, 42, and 44 in a plating solution according to the fourth embodiment. FIG. 12A illustrates the entire configuration including conducting devices 45 to 46. FIG. 12B corresponds to FIG. 2B and illustrates a cross-sectional structure including first, second, and third plated surfaces of the base material 20.

In the first embodiment, the segmented anodes 31 to 34, each of which is configured so that the block anodes 60 are housed in an associated one of the metal cases 50*a* to 50*d*, are appropriately disposed so as to face parts of associated ones of the plated surfaces 21 to 24 of the base material 20. The segmented anodes 31 to 34 are formed so as to be small, in comparison with the size of the base material 20. On the other hand, according to the fourth embodiment, as illustrated in FIG. 12A, first and second segmented anodes (stick-like anodes) 41 and 42, each of which is obtained by forming a stick-like copper material into a shape corresponding to the shape of an associated one of the plated surfaces 22 to 24, are disposed in the second plated surface 22, the third plated surface 23, and the fourth plated surface 24 so as to face parts of the plated surfaces 22 to 24. Also, according to the present embodiment, a third segmented anode 44 of the case housing type, in which block anodes 60 made of copper are housed in a titanium metal case 43 having a size substantially equal to that of the base material 20, is disposed so as to be separated from the base material 20. That is, according to the present embodiment, electroplating is performed using the stick-like two segmented anodes 41 and 42 and the single segmented anode 44 of the case housing type. In a case where the anodes 41, 42, and 43 are dissolved and reduced in size by electroplating, new block anodes 60 are replenished into the segmented anode 44 of the case housing type, and the stick-like segmented anodes 41 and 42 themselves are replaced with new ones, similarly to the first embodiment.

More particularly, the base material 20 and the segmented anodes 41, 42, and 44 are disposed so that among the plated surfaces 21 to 24 of the base material 20, the first plated surface 21 is close to the third segmented anode 44 of the case housing type and faces the third segmented anode 44 from the front thereof, as illustrated in FIG. 12B. Further, the third plated surface 23 and the fourth plated surface 24 (not shown in FIG. 12B) do not face the third segmented anode 44 from the front thereof (the third plated surface 23 and the fourth plated surface 24 are disposed to be slightly inclined to the third segmented anode 44). The second plated surface 22 is disposed so that the back surface of the second plated surface 22 is directed to the third segmented anode 44. Therefore, in a case where electroplating is performed using only the third segmented anode 44 without using the first segmented anode 41 and the second segmented anode 42, copper plating is performed on the entire plated surfaces 21 to 24. However, this can cause a situation in which the film thickness of the copper film formed on the first plated surface 21 by copper-plating is large, and in which the thickness of the film formed on the other parts is small, as compared with the thickness of the film formed on the first plated surface 21. Thus, according to the present embodiment, the first segmented anode 41 and the second segmented anode 42 are disposed so as to face the second plated surface 22 to the fourth plated surface 24.

Figure 13:
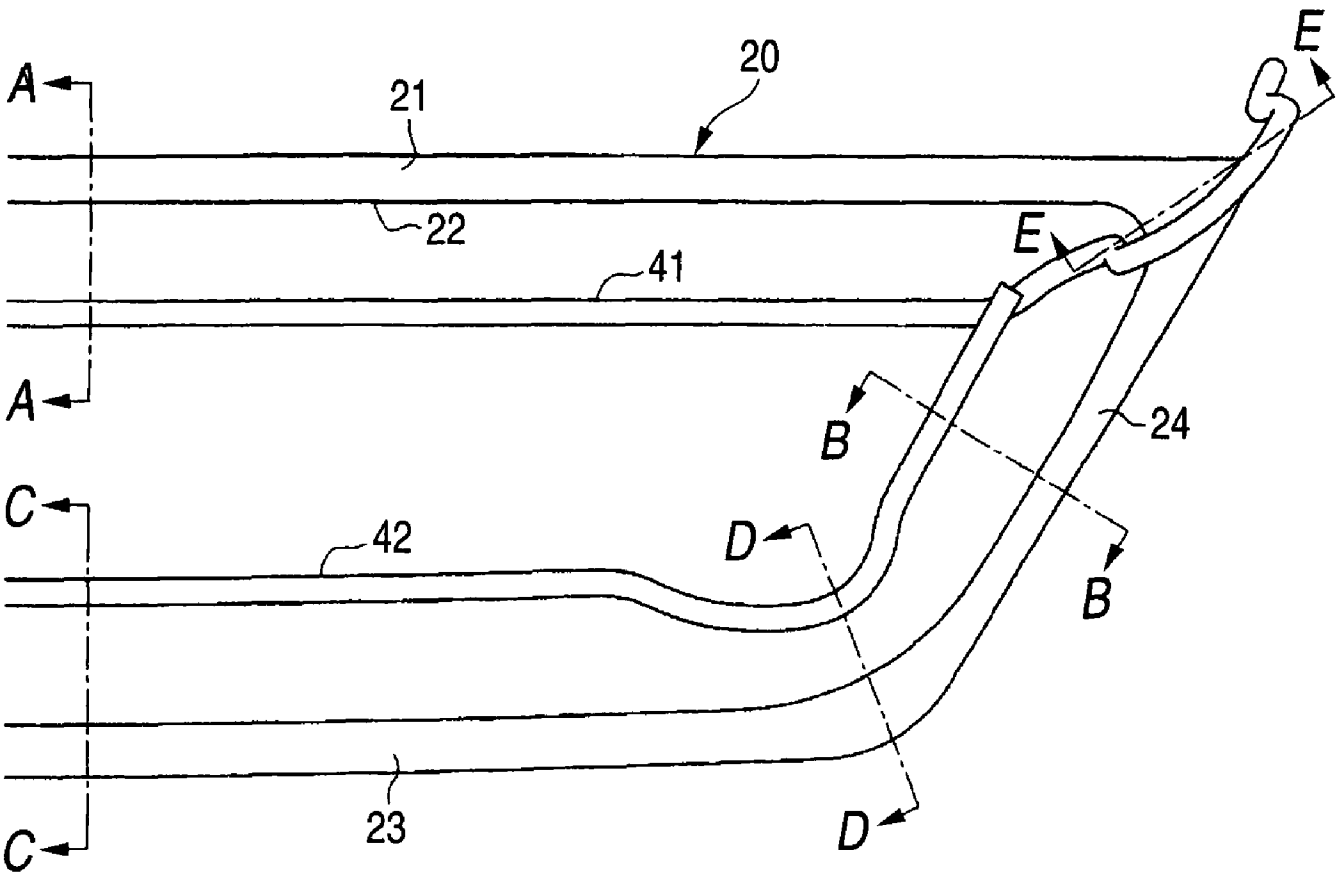
FIG. 13 is a schematic view illustrating the configuration arrangement of a base material and stick-like segmented anodes at electroplating in the method for fabricating a plated product according to the fourth embodiment of the invention.

FIG. 13 illustrates the manner of configuring the first segmented anode 41 and the second segmented anode 42 with respect to the base material 20. As illustrated in FIGS. 12A, 12B and 13, the first segmented anode 41 extends along the second plated surface 22 of the base material 20. Both the end sides of the first segmented anode 41 are bent corresponding to the border portion between the second plated surface 22 and the fourth plated surface 24 and to the periphery thereof. The second segmented anode 42 is formed into a shape corresponding to the third plated surface 23 and the fourth plated surface 24. Thus, by forming the stick-like segmented anodes 41 and 42 into shapes corresponding to the plated surfaces, distances from each part of the plated surfaces to the segmented anodes 41 and 42 are changed.

Figure 14A:
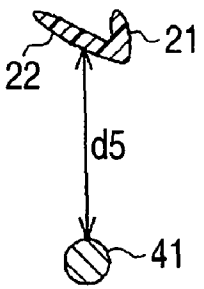
FIGS. 14A, 14B, 14C, 14D, and 14E are cross-sectional views respectively taken on line A-A, line B-B, line C-C, line D-D, and line E-E.
Figure 14B:
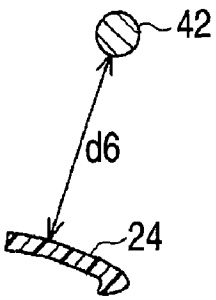
Figure 14C:
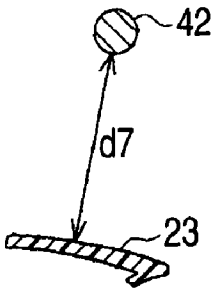
Figure 14D:
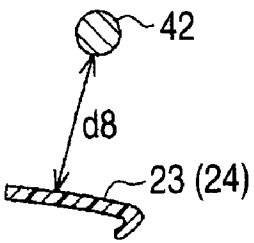
Figure 14E:
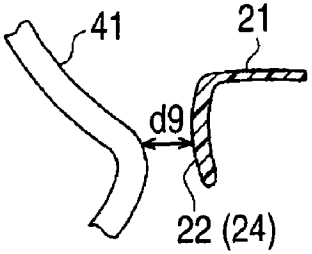

FIGS. 14A to 14E illustrate cross-sectional structures at parts, which are taken on lines A-A to E-E shown in FIG. 13. As illustrated in FIG. 14A, a central portion in the longitudinal direction of the second plated surface 22 is such that the distance therefrom to the first segmented anode 41 is set at a length d5. As illustrated in FIG. 14B, a central portion in the longitudinal direction of the fourth plated surface 24 is such that a distance therefrom to the second segmented anode 42 is set at a length d6 that is substantially equal to the length d5. As illustrated in FIG. 14C, a central portion in the longitudinal direction of the third plated surface 23 is such that a distance therefrom to the second segmented anode 42 is set at a length d7 that is substantially equal to each of the lengths d5 and d6. However, as illustrated in FIG. 14D, the border portion between the third plated surface 23 and the fourth plated surface 24 is such that a distance therefrom to the second segmented anode 42 is set at a length d8 that is shorter than each of the lengths d5 to d7. Further, as illustrated in FIG. 14E, the border portion between the second plated surface 22 and the fourth plated surface 24 is such that a distance therefrom to the second segmented anode 42 is set at a length d9 that is shorter than the length d8.

That is, the central portions of the second plated surface 22 to the fourth plated surfaces 24 are flat, so that t the central portions can be regarded as concave portions having a curvature of "0". A distance from the border portion between the third plated surface 23 and the fourth plated surface 24, which portion includes a concave part having a large curvature, to the segmented anode 42 is set to be shorter than the distances between the flat parts and the anodes 41 and 42. A distance from the border portion between the second plated surface 22 and the fourth plated surface 24, which portion includes a concave part having a larger curvature, to the second segmented anode 42 is set to be shorter than the distance from the border portion between the third plated surface 23 and the fourth plated surface 24. Thus, in the present embodiment, the first segmented anode 41 and the second segmented anode 42 are disposed to the sides of the plated surfaces 21 to 24, so that distances to the anodes 41 and 42 from each part of the plated surfaces 21 to 24 become shorter with increase in the curvature of a concave portion which is formed at each part of the plated surfaces 21 to 24 so as to be away from the anodes.

Further, according to the present embodiment, as illustrated in FIGS. 12A and 12B, the first segmented anode 41, the second segmented anode 42, and the third segmented anode 43 are connected to different conducting devices 45, 46, and 47, respectively. Further, a voltage to be applied between the first segmented anode 41 and the base material 20, a voltage to be applied between the second segmented anode 42 and the base material 20, and a voltage to be applied between the third segmented anode 43 and the base material 20 are individually set. Accordingly, the current density at each part of the plated surfaces 21 to 24 can be more uniformed by appropriately setting a voltage that is applied between the base material 20 and each of the first segmented anode 41, the second segmented anode 42, and the third segmented anode 43 by an associated one of the electrically conducting devices 45, 46, and 47. Incidentally, it is unnecessary to individually use the electrically conducting devices 45, 46, and 47 for the first segmented anode 41, the second segmented anode 42, and the third segmented anode 43, respectively. Even in the case of using only a single conducting device, it is sufficient that the voltage to be applied between the base material 20 and each of the segmented anodes 41, 42, and 43 can be individually set. Preferably, the voltage to be applied therebetween is appropriately set according to the distances from each of the plated surfaces 21 to 24 of the base material 20 to the segmented anodes 41, 42, and 43 or according to the shape of each part of the plated surfaces 21 to 24 of the base material. Constituent elements and operations thereof, which are specifically referred to herein, are the same as those of the first embodiment.

As described above in detail, the fourth embodiment can have the advantages (1) and (3) of the above embodiments and the following advantages (7) to (9).

(7) In the method for fabricating a plate product according to the fourth embodiment, the first stick-like segmented anode 41 and the second stick-like segmented anode 42 are used as the anode. Therefore, the distances from each part of the plated surfaces to the segmented anodes 41 and 42 can be changed by forming a stick-like copper material into a shape corresponding to the shape of each plated surface through a processing method that can easily be performed, e.g., a press molding method. In a case where the stick-like segmented anodes 41 and 42 are dissolved and reduced in size by electroplating, the replacement of the segmented anodes 41 and 42 can be performed with small effort by, e.g., detaching the segmented anodes 41 and 42 from electrodes of the electrically conducting devices 45 and 46 for electroplating, and attaching new segmented anodes 41 and 42 thereto.

(8) In the method for fabricating a plate product according to the fourth embodiment, the voltage to be applied between the base material 20 and each of the anodes 41, 42, and 43 by an associated one of the electrically conducting devices 45, 46, and 47 is set individually corresponding to the segmented anodes 41, 42, and 44. Accordingly, the current density at each part of the plated surfaces 21 to 24 can be more uniformed by appropriately setting the voltage to be applied between the base material 20 and each of the anodes 41, 42, and 43. The thickness of a film formed on each of the plated surfaces 21 to 24 of the base material 20 by copper plating performed thereon can be more uniformed.

(9) According to the present embodiment, electroplating is performed on the entire plated surfaces 21 to 24 using the segmented anode 44 having a size which is comparable to that of the base material 20. Further, the stick-like segmented anodes 41 and 42 are made to face the plated surfaces 22 to 24, the copper plated films on which are likely to be thin in the case of using only the segmented anode 44. Accordingly, there is no need for disposing the stick-like segmented anodes 41 and 42 by being made to correspond to all the plated surfaces 21 to 24. Also, there is no necessity for using many kinds of stick-like anodes formed into a shape for exclusive use with a specific plated product. Moreover, in a case where electroplating is performed using only the segmented anode 44 having a size which is comparable to that of the base material 20, the stick-like segment anodes 41 and 42 are disposed close to the plated surfaces 22 to 24, the copper plated films on which are likely to be thin. Thus, a time required to perform electroplating can be short, as compared with the case of using only the segmented anode 44 whose size is comparable to that of the base material 20.

Other Embodiments

Incidentally, the invention can be embodied into the following modifications.

Although the anode includes the segmented-anodes in each of the first and second embodiments, the anode can be constituted by a single device without being divided. That is, in a case where convexities and concavities are formed on each part of the plated surfaces, the anode can be formed according to the shapes of the plated surfaces so that the distances from each part of the plated surfaces to the anode increase with increase in the curvature of each of the convexities formed on the plated surfaces, and that the distances from each part of the plated surfaces to the anode decrease with increase in the curvature of each of the concavities formed on the plated surfaces. Although the anode is constituted by a single device without being divided in the third embodiment, segmented anodes can be used instead of using the single device as the anode. That is, the anode including the segmented-anodes can be disposed so as to face the medial part of the base material, which part is other than the parts corresponding to the extra width X at both end portions of each of the plated surfaces. Additionally, in a case where the anode includes the segmented-anodes in each of the embodiments, the segmented-anodes are limited neither to the block anodes housed in the metal cases nor to the stick-like ones. Plate-like and sphere segmented-anodes can appropriately be used.

The above embodiments can appropriately be combined with one another. That is, in a case where convexities and concavities are formed on each part of the plated surfaces, the anode can be made to face only the medial part, which is other than the parts corresponding to the extra width X at both end portions of each of the plated surfaces, so that the distance from each part of the plated surfaces to the anode increases with increase in the curvature of each of the convexities formed on the plated surfaces and that the distance from each part of the plated surfaces to the anode decreases with increase in the curvature of each of the concavities formed on the plated surfaces.

In the case of using the segmented anodes 31 to 34 of the first embodiment, when a voltage is applied between the base material 20 and each of the segmented anodes 31 to 34 by the electrically conducting device, the voltage can be set individually corresponding to each of the segmented anodes 31 to 34. In the fourth embodiment, the same voltage can be applied to the segmented anodes 41, 42, and 43 without setting individual voltages to be applied to the segmented anodes 41, 42, 43, and 44. Further, an appropriate combination of the segmented anodes 31 to 34 used in the first embodiment and the stick-like segmented anodes 41 and 42 and the case housing type segmented anode 44, which have been described in the foregoing description of the fourth embodiment, can be used as the anode for electroplating. In this case, the same voltage can be applied between the base material and each of the segmented anodes. Alternatively, a voltage to be applied between the base material and each of the segmented anodes can be set individually corresponding to each of the anodes.

Although the fourth embodiment uses both kinds of the segmented anodes, i.e., the stick-like segmented anodes 41 and 42 and the case housing type segmented anode 44, only the stick-like segmented anodes can be used. That is, e.g., in a case where copper plating is performed on the base material 20 of the fourth embodiment, the stick-like anode corresponding to the first plated surface 21 can be provided, instead of the third segmented anode 44. In this case, the same voltage can be applied between the base material and each of the segmented anodes. Alternatively, a voltage to be applied between the base material and each of the segmented anodes can be set individually corresponding to each of the segmented anodes.

The metal film formed on the plated product according to each of the above embodiments can be made of a metal other than copper. Examples of the metal other than copper are nickel, gold, zinc, chromium, and silver. That is, the exemplified metal, such as nickel, gold, zinc, chromium, and silver, can be used as the soluble metal serving as the material of the anode. Alternatively, an insoluble metal can be used as the material of the anode, and the soluble metal can be dissolved into a plating solution. Metals used as the materials of the anode are not limited to iron and aluminum.

Although the vehicle bumper molding 10 has been exemplified as the plated product in the foregoing description of the first embodiment, the plated product is not limited to a bumper molding. Although it has been described in the description of each of the embodiments that a part of each of the base embodiments is used as the plated surface, instead of the entire peripheral surface of the base material, the entire peripheral surface of the base material can be used as the plated surface. Thus, a metal film can be formed on the entire peripheral surface of the base material.

What is claimed is:

1. A method for fabricating a plate product by disposing an anode at the side of a surface of a base material, which is to be plated, and performing electroplating on said surface of said base material so as to form a metal film on said plated surface, wherein at the electroplating, said anode is configured to face a medial part of said base material, said medial part being arranged between end portions of said plated surface, and said end portions of said plated surface each having a predetermined width, wherein said anode includes a plurality of segmented-anodes electrically connected to an electrically conducting device for electroplating, and wherein at least one of said plurality of segmented-anodes is configured so that a plurality of block anodes made of a soluble metal are housed in a case made of an insoluble metal; and said case is electronically connected to said electrically conducting device for electroplating, and has an opening open in a part provided at the side of said plated surface.

2. The method for fabricating a plated product according to claim 1, wherein said anode includes a stick-shaped anode made of stick-shaped soluble metal and formed into a shape corresponding to a shape of said plated surface.

3. The method for fabricating a plated product according to claim 1, wherein a voltage to be applied between said base material and each of said plurality of segmented-anodes by said electrically conducting device is set individually corresponding to said segmented-anodes.

4. The method for fabricating a plated product according to claim 1, wherein said case has a pressing member for pressing said block anode against an inner wall of said case.

5. The method for fabricating a plated product according to claim 1, wherein said plated surface includes a convex part, and said anode is disposed so that at the electroplating, a distance from each part of said plated surface to said anode increases with an increase in a curvature of said convex part protruding toward said anode at each part of said plated surface.

6. The method for fabricating a plated product according to claim 1, wherein said plated surface includes a concave part, and said anode is disposed so that at the electroplating, a distance from each part of said plated surface to said anode decreases with an increase in a curvature of said concave part which is formed on each part of said plated surface so as to be away from said anode.

7. A method for fabricating a plate product by disposing an anode at the side of a surface of a base material and configured to face a medial part of said base material, which is to be plated, and performing electroplating on said surface of said base material so as to form a metal film on said plated surface, and where said plated surface includes a convex part, said anode is disposed so that at the electroplating, a distance from each part of said plated surface to said anode increases with increase in a curvature of said convex part protruding toward said anode at each part of said plated surface, and where said plated surface includes a concave part, said anode is disposed so that at the electroplating, a distance from each part of said plated surface to said anode decreases with increase in a curvature of said concave part which is formed on each part of said plated surface so as to be away from said anode, wherein said anode includes a plurality of segmented-anodes electrically connected to an electrically conducting device for electroplating, and wherein at least one of said plurality of segmented-anodes is configured so that a plurality of block anodes made of a soluble metal are housed in a case made of an insoluble metal; and said case is electronically connected to said electrically conducting device for electroplating, and has an opening open in a part provided at the side of said plated surface.

8. The method for fabricating a plated product according to claim 7, wherein said anode includes a stick-shaped-anode configured so that a distance to said anode from each part of said plated surface is changed by forming a stick-shaped soluble metal into a shape corresponding to a shape of said plated surface.

9. The method for fabricating a plated product according to claim 7, wherein a voltage to be applied between said base material and each of said plurality of segmented-anodes by said electrically conducting device is set individually corresponding to said segmented-anodes.

10. The method for fabricating a plated product according to claim 7, wherein said case has a pressing member for pressing said block anode against an inner wall of said case.

11. A method for fabricating a plate product by disposing an anode at the side of a surface of a base material and configured to face a medial part of said base material, which is to be plated, and performing electroplating on said surface of said base material so as to form a metal film on said plated surface, wherein for any said plated surface including a convex part, said anode is disposed so that at the electroplating, a distance from each part of said plated surface to said anode increases with increase in a curvature of said convex part protruding toward said anode at each part of said plated surface, and wherein for any said plated surface including a concave part, said anode is disposed so that at the electroplating, a distance from each part of said plated surface to said anode decreases with increase in a curvature of said concave part which is formed on each part of said plated surface so as to be away from said anode, wherein said anode includes a plurality of segmented-anodes electrically connected to an electrically conducting device for electroplating, and wherein at least one of said plurality of segmented-anodes is configured so that a plurality of block anodes made of a soluble metal are housed in a case made of an insoluble metal; and said case is electronically connected to said electrically conducting device for electroplating, and has an opening open in a part provided at the side of said plated surface.

12. The method for fabricating a plated product according to claim 11, wherein said anode includes a stick-shaped-anode configured so that a distance to said anode from each part of said plated surface is changed by forming a stick-shaped soluble metal into a shape corresponding to a shape of said plated surface.

13. The method for fabricating a plated product according to claim 11, wherein a voltage to be applied between said base material and each of said plurality of segmented-anodes by said electrically conducting device is set individually corresponding to said segmented-anodes.

14. The method for fabricating a plated product according to claim 11, wherein said case has a pressing member for pressing said block anode against an inner wall of said case.

* * * * *